US008367293B2

(12) United States Patent
Ohtani et al.

(10) Patent No.: US 8,367,293 B2
(45) Date of Patent: Feb. 5, 2013

(54) METHOD FOR PRODUCING CARRIER FOR ELECTROPHOTOGRAPHIC DEVELOPER, CARRIER FOR ELECTROPHOTOGRAPHIC DEVELOPER, ELECTROPHOTOGRAPHIC DEVELOPER, AND IMAGE FORMING METHOD

(75) Inventors: Shinji Ohtani, Shizuoka (JP); Ryota Inoue, Shizuoka (JP); Yoshihiro Norikane, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 394 days.

(21) Appl. No.: 12/809,415

(22) PCT Filed: Dec. 18, 2008

(86) PCT No.: PCT/JP2008/073672

§ 371 (c)(1),
(2), (4) Date: Jun. 18, 2010

(87) PCT Pub. No.: WO2009/078493

PCT Pub. Date: Jun. 25, 2009

(65) Prior Publication Data

US 2010/0310982 A1 Dec. 9, 2010

(30) Foreign Application Priority Data

Dec. 19, 2007 (JP) ..... 2007-328017
Aug. 27, 2008 (JP) ..... 2008-218515

(51) Int. Cl.
*G03G 5/00* (2006.01)

(52) U.S. Cl. ..... 430/137.13; 430/111.3; 430/111.31; 430/111.4; 430/111.41

(58) Field of Classification Search ..... 430/137.13, 430/111.3, 111.31, 111.4, 111.41
See application file for complete search history.

(56) References Cited

U.S. PATENT DOCUMENTS

| | | | |
|---|---|---|---|
| 7,709,175 | B2 | 5/2010 | Ohtani |
| 2004/0253528 | A1 | 12/2004 | Yamashita et al. |
| 2007/0059628 | A1 | 3/2007 | Tanaka et al. |
| 2007/0082286 | A1 | 4/2007 | Yamashita et al. |
| 2007/0180661 | A1 | 8/2007 | Aga et al. |
| 2007/0243482 | A1 | 10/2007 | Yamaguchi et al. |

(Continued)

FOREIGN PATENT DOCUMENTS

| | | |
|---|---|---|
| EP | 1703332 | 9/2006 |
| EP | 1715387 | 10/2006 |

(Continued)

OTHER PUBLICATIONS

Canadian Office Action issued Sep. 12, 2011, in Patent Application No. 2,710,091.

(Continued)

*Primary Examiner* — Mark A Chapman
(74) *Attorney, Agent, or Firm* — Oblon, Spivak, McClelland, Maier & Neustadt, L.L.P.

(57) ABSTRACT

A method for producing a carrier, including a step of periodically forming and discharging liquid droplets of a carrier core composition liquid from a plurality of nozzles formed in a thin film, using a liquid droplet forming unit having the thin film and a ring-shaped vibration generating unit disposed in a deformable area of the thin film so as to be along a circumference of the area and to vibrate the thin film, a step of forming carrier core particles by solidifying the discharged liquid droplets, and a step of coating the carrier core particles with a resin layer.

15 Claims, 24 Drawing Sheets

U.S. PATENT DOCUMENTS

| | | | |
|---|---|---|---|
| 2008/0063971 | A1 | 3/2008 | Watanabe et al. |
| 2008/0241727 | A1 | 10/2008 | Norikane et al. |
| 2008/0248416 | A1 | 10/2008 | Norikane et al. |
| 2008/0286679 | A1 | 11/2008 | Norikane et al. |
| 2008/0286680 | A1 | 11/2008 | Norikane et al. |

FOREIGN PATENT DOCUMENTS

| | | |
|---|---|---|
| EP | 1810744 | 7/2007 |
| JP | 10 198077 | 7/1998 |
| JP | 2832013 | 12/1998 |
| JP | 3029180 | 4/2000 |
| JP | 2004 233905 | 8/2004 |
| JP | 2006 297325 | 11/2006 |
| JP | 2007 108731 | 4/2007 |
| JP | 2007 171499 | 7/2007 |
| JP | 2007 216213 | 8/2007 |

OTHER PUBLICATIONS

Supplemental Search Report issued Sep. 3, 2012, in European patent application No. 08863118.9.

METHOD FOR PRODUCING CARRIER FOR ELECTROPHOTOGRAPHIC DEVELOPER, CARRIER FOR ELECTROPHOTOGRAPHIC DEVELOPER, ELECTROPHOTOGRAPHIC DEVELOPER, AND IMAGE FORMING METHOD

TECHNICAL FIELD

The present invention relates to a method for producing a carrier for electrophotographic developer containing a carrier core and a resin layer formed thereon; a carrier for electrophotographic developer; an electrophotographic developer; and an image forming method.

BACKGROUND ART

As has been known, developing processes in electrophotography use one-component developers containing a toner as the only main component or use two-component developers containing a carrier and a toner in a mixed state. The developing processes using the two-component developers are advantageous over those using the one-component developers in that a high-quality image can be consistently formed for a long period of time, since the two-component developers contain the powdery carrier providing a large area for frictionally charging the toner and provide excellent charge rising property and charge stability. This is because the powdery carrier has a specific surface area remarkably larger than the surface area of a charging sleeve commonly used in the developing processes using the one-component developers, increasing the chance of the contact between the carrier and the toner. For the above reasons, developing processes using two-component developers are employed in digital electrophotographic systems where a latent electrostatic image is formed on a photoconductor using, for example, a laser beam and then the formed latent electrostatic image is visualized.

In an attempt to increase resolution and highlight reproducibility and to respond to formation of color images, the recent interest has focused on formation of a high-density latent image having a minimum unit (1 dot) which is as small as possible. In view of this, keen demand has arisen for development systems where such a latent image (dot) can be developed with fidelity. Under such circumstances, various attempts have been made to find out optimum process conditions and to desirably modify developers; e.g., toners and carriers. Regarding process conditions, it is advantageous that, for example, the developing gap is made to be small, photoconductors are made to be thin and a writing beam diameter is made to be small. However, these measures pose serious problems such as cost elevation and degradation of reliability.

Also, use of toners having a small particle diameter remarkably improves dot reproducibility, but developers containing such toners problematically cause, for example, background smear, insufficient image density and toner spent on carriers. As compared with black toners, full-color toners, which is used in combination with a resin having a low softening point for attaining sufficient color tone, cause considerable toner spent on the carriers to degrade the developers, resulting in easily causing toner scattering and background smear.

Various Patent Literatures disclose use of a carrier having a small particle diameter. For example, Patent Literature 1 discloses a developing method including reversely developing, in an applied bias electric field formed of AC and DC components at a developing section, a latent electrostatic image formed on a latent image bearing member containing an organic photoconductive layer, using a magnetic brush of a two-component developer containing a carrier and a toner borne on a developer bearing member. In this method, the toner has the same charge polarity as the latent electrostatic image; and the carrier contains a carrier core having ferrite particles and an electrical insulating resin applied thereon in an amount of 0.1% by mass to 5.0% by mass with respect to the carrier core, and has a weight average particle diameter of 30 μm to 65 μm and an average pore size thereon of 1,500 angstrom to 30,000 angstrom.

Patent Literature 2 discloses an electrophotographic carrier having a 50% average particle diameter (D50) of 15 μm to 45 μm, the electrophotographic carrier containing carrier particles having a particle diameter of 22 μm or smaller in a ratio of 1% to 20%, carrier particles having a particle diameter of 16 μm or smaller in a ratio of 3% or less, carrier particles having a particle diameter of 62 μm or larger in a ratio of 2% to 15% and carrier particles having a particle diameter of 88 μm or larger in a ratio of 2% or less, wherein a specific surface area S1 as measured by an air permeation method and a specific surface area S2 calculated by the equation $S2=(6/\rho \cdot D50)\times 10^4$ (wherein ρ denotes a specific gravity of the carrier) satisfy the relation $1.2 \leqq S1/S2 \leqq 2.0$.

Patent Literature 3 discloses a carrier used in a developer for developing a latent electrostatic image, the carrier having a 50% volume average particle diameter (D50) of 30 μm to 80 μm, having a ratio of the 50% volume average particle diameter to a 10% volume average particle diameter (D50/D10) of 1.8 or lower, having a ratio of a 90% volume average particle diameter to the 50% volume average particle diameter (D90/D50) of 1.8 or lower, containing carrier particles having a volume particle diameter of 20 μm or less in a ratio less than 3% and having a magnetization of 52 emu/g to 65 emu/g at 1 kOe.

Use of such small carrier having a large surface area exhibits advantageous effects as described below:

(1) each toner particles can be sufficiently frictionally-charged to reduce toner particles having a low charging amount and reversely charged toner particles, resulting in that background smear is less likely to occur and excellent dot reproducibility can be attained (i.e., less toner scattering and bleeding);

(2) the average charging amount of toner particles can be decreased to form an image having a sufficient image density:

(3) when it is used in combination with toner particles having a small particle diameter, the coverage of the carrier with the toner particles is not high, resulting in avoiding failures caused by using such toner particles and making them to exhibit their advantageous effects; and (4) a dense magnetic brush whose toner particle chains have excellent flowability is formed to reduce, on the formed image, trails of the chains.

However, when such carrier having a small particle diameter is produced with the conventionally known production method employing, as a liquid droplet forming section, a rotating disc or a two-fluid nozzle, the particle size distribution of the formed liquid droplets is problematically very broader than that of the carrier of interest. Thus, classification must be repeatedly performed for producing the target small carrier, and in general, the production yield is decreased to as low as several tens percent.

In an attempt to overcome the aforementioned problems occurring during production of such small carrier, Patent Literatures 4 and 5 disclose a vibrating-orifice granulator and an ink-jet granulator, respectively. In these granulators, a carrier composition liquid is discharged from nozzles having a pore size smaller than the size of the formed liquid droplets. Thus, nozzle clogging often occurs which is caused by foreign matter (e.g., dust) and/or aggregates of magnetic powder contained in the carrier composition liquid. In order to avoid this problem, there is provided an additional step for increasing dispersibility of a slurry containing magnetic powder. In addition, filtration is repeatedly performed and/or a cleaning mechanism for nozzles is provided. None of these measures have attained satisfactorily reliable carrier-production.

With reference to FIG. 1, next will be briefly described a vibrating-orifice granulator based on the principle of liquid droplet formation described in Patent Literature 4.

This apparatus includes a housing 501, an opening 502 formed in the housing 501, a nozzle plate 503 having nozzles (openings) (serving as a discharge member), a flow passage member 504 screwed on the housing 501, an O-ring 505, a flow passage 506 provided in the flow passage member 504, an insulating support 507, a hollow counter electrode 508 and a DC power source 509, the nozzle plate 503 facing the opening 502 and being secured via the O-ring 505 by the end surface of the flow passage member 504. With this configuration, when the nozzle plate 503 is vibrated by an unillustrated vibration generating unit, a slurry fed through the flow passage 506 is discharged downwardly in a form of liquid droplet from the nozzles of the nozzle plate 503. Notably, the granulator disclosed in Patent Literature 5 is called a continuous ink-jet granulator, which is the same in principle as the vibrating-orifice granulator disclosed in Patent Literature 4.

Also, below the nozzle plate 503 is provided the hollow counter electrode 508 secured by the insulating support 507. A DC high voltage is applied to the hollow counter electrode 508 from the DC power source 509. Further, dispersing gas 511 is fed through the gap between the support 507 and the housing 501 toward an underside surface of the nozzle plate 503, and the slurry is discharged downstream from the nozzle plate 503 as liquid droplets 510 through the counter electrode 508.

A carrier production method using the above-described vibrating-orifice (continuous ink-jet) granulator disclosed in Patent Literatures 4 and 5 can produce carrier having a sharp particle size distribution, which carrier has been demanded for avoiding carrier adhesion.

However, a carrier composition liquid containing aggregated particles easily causes nozzle clogging, making it difficult to continue particle formation for a long period of time. In other words, when a slurry containing magnetic powder in a dispersed state is discharged from nozzles having a small pore size using the conventional apparatuses based on vibrating-orifice (continuous ink-jet) granulation, nozzle clogging often occurs and it is difficult to continuously produce particles over a long period of time.

Patent Literature 1: Japanese Patent (JP-B) No. 2832013
Patent Literature 2: JP-B No. 3029180
Patent Literature 3: Japanese Patent Application Laid-Open (JP-A) No. 10-198077
Patent Literature 4: JP-A No. 2007-171499
Patent Literature 5: JP-A No. 2007-216213

DISCLOSURE OF INVENTION

Accordingly, an object of the present invention is to provide a production method capable of consistently producing, for a long period of time, a highly durable carrier for electrophotographic developer having a small particle diameter and a sharp particle size distribution, which carrier can provide a high-quality image excellent in dot reproducibility and highlight reproducibility, can form an image having high image density with less background smear, and cannot cause inductive carrier adhesion even after long-term use.

Also, an object of the present invention is to provide a carrier for electrophotographic developer produced with the production method of the present invention, an electrophotographic developer containing the carrier, and an image forming method using the developer.

Means for solving the foregoing problems are as follows:

<1> A method for producing a carrier, including:

periodically forming and discharging liquid droplets of a carrier core composition liquid from a plurality of nozzles formed in a thin film, using a liquid droplet forming unit having the thin film and a vibration generating unit configured to vibrate the thin film, forming carrier core particles by solidifying the discharged liquid droplets, and coating the carrier core particles with a resin layer.

<2> The method according to the item <1>, wherein the vibration generating unit is a ring-shaped vibration generating unit disposed in a deformable area of the thin film so as to be along a circumference of the area.

<3> The method according to any one of the items <1> and <2>, wherein the thin film of the liquid droplet forming unit has a convex portion which is formed with a plurality of nozzles and projects in a direction in which the liquid droplets are discharged.

<4> The method according to any one of the items <1> to <3>, wherein the thin film is formed of a metal plate having a thickness of 5 μm to 100 μM, and each of the nozzles has a pore size of 10 μm to 50 μm.

<5> The method according to any one of the items <1> to <3>, wherein the nozzles are vibrated at a vibration frequency of 20 kHz to 300 kHz.

<6> The method according to the item <1>, wherein the liquid droplet forming unit further includes a vibration amplifying unit which is configured to amplify a vibration generated from the vibration generating unit and which has a vibration applying, surface for applying the vibration to a target, the vibration applying surface being disposed so as to face the thin film, and a liquid feeding unit configured to feed the carrier core composition liquid to a space between the vibration applying surface and the thin film.

<7> The method according to the item <6>, wherein the vibration amplifying unit is a horn vibrator.

<8> The method according to any one of the items <6> and <7>, wherein the vibration generating unit is configured to generate a vibration having a frequency falling within a range of 20 kHz or higher and lower than 2.0 MHz.

<9> The method according to any one of the items <6> to <8>, wherein the plurality of nozzles are formed in the thin film so as to be arranged in an area where a sound pressure transmitted from the vibration amplifying unit falls within a range of 10 kPa to 500 kPa.

<10> The method according to any one of the items <6> to <9>, wherein the plurality of nozzles are formed in the thin film so as to be arranged in an extended area from a position where a maximum displacement caused by a vibration is obtained to a position where a displacement is equal to or higher than 50% of the maximum displacement.

<11> A carrier including:

carrier core particles, wherein the carrier is obtained by the method according to any one of claims 1 to 10 so as to have a weight average particle diameter D4 of 15 μm to 35 μm, and wherein a ratio (D4/Dn) of the weight average particle diameter D4 to a number average particle diameter Dn is 1.0 to 1.5.

<12> The carrier according to the item <11>, wherein the bulk density is 2.15 g/cm$^3$ to 2.70 g/cm$^3$ and the carrier core particles have a magnetization of 40 emu/g to 150 emu/g when a magnetic field of 1,000 Oersted is applied thereto.

<13> The carrier according to any one of the items <11> and <12>, wherein the carrier core particles are formed of an MnMgSr ferrite.

<14> The carrier according to any one of the items <11> and <12>, wherein the carrier core particles are formed of an Mn ferrite.

<15> The carrier according to any one of the items <11> and <12>, wherein the carrier core particles are formed of a magnetite.

<16> The carrier according to any one of the items <11> to <15>, having a resin layer formed of a silicone resin.

<17> The carrier according to the item <16>, wherein the resin layer contains an amino silane coupling agent.

<18> A developer including:

a toner, and the carrier according to any one of the items <11> to <17>.

<19> The developer according to the item <18>, wherein the toner is charged with an absolute charging amount of 15 μc/g to 50 μc/g when the coverage of the carrier with the toner is 50%.

<20> The developer according to any one of the items <18> and <19>, wherein the toner has a weight average particle diameter of 3.0 μm to 6.0 μm.

<21> An image forming method including:

charging a surface of an image bearing member, exposing the charged surface of the image bearing member to light to form a latent electrostatic image, developing the latent electrostatic image with the developer according to any one of the items <18> to <20>, to thereby form a visible image, transferring the visible image onto an recording medium, and fixing the transferred image on the recording medium.

The method for producing a carrier (carrier production method) of the present invention includes a step of periodically forming and discharging liquid droplets of a carrier core composition liquid from a plurality of nozzles formed in a thin film, using a liquid droplet forming unit having the thin film and a vibration generating unit configured to vibrate the thin film, a step of forming carrier core particles by solidifying the discharged liquid droplets, and a step of coating the carrier core particles with a resin layer. This carrier production method can consistently produce, for a long period of time, a highly durable carrier for electrophotographic developer having a small particle diameter and a sharp particle size distribution, which carrier can provide a high-quality image and cannot cause inductive carrier adhesion even after long-term use.

The carrier produced by the carrier production method of the present invention is a highly durable carrier for electrophotographic developer having a small particle diameter and a sharp particle size distribution. This carrier can provide a high-quality image and cannot cause inductive carrier adhesion even after long-term use.

The developer of the present invention contains a toner and the carrier of the present invention and thus, can provide a high-quality image.

The image forming method of the present invention uses the developer of the present invention and thus, can provide a high-quality image.

BEST MODE FOR CARRYING OUT THE INVENTION

Carrier Production Method

Figure 1:
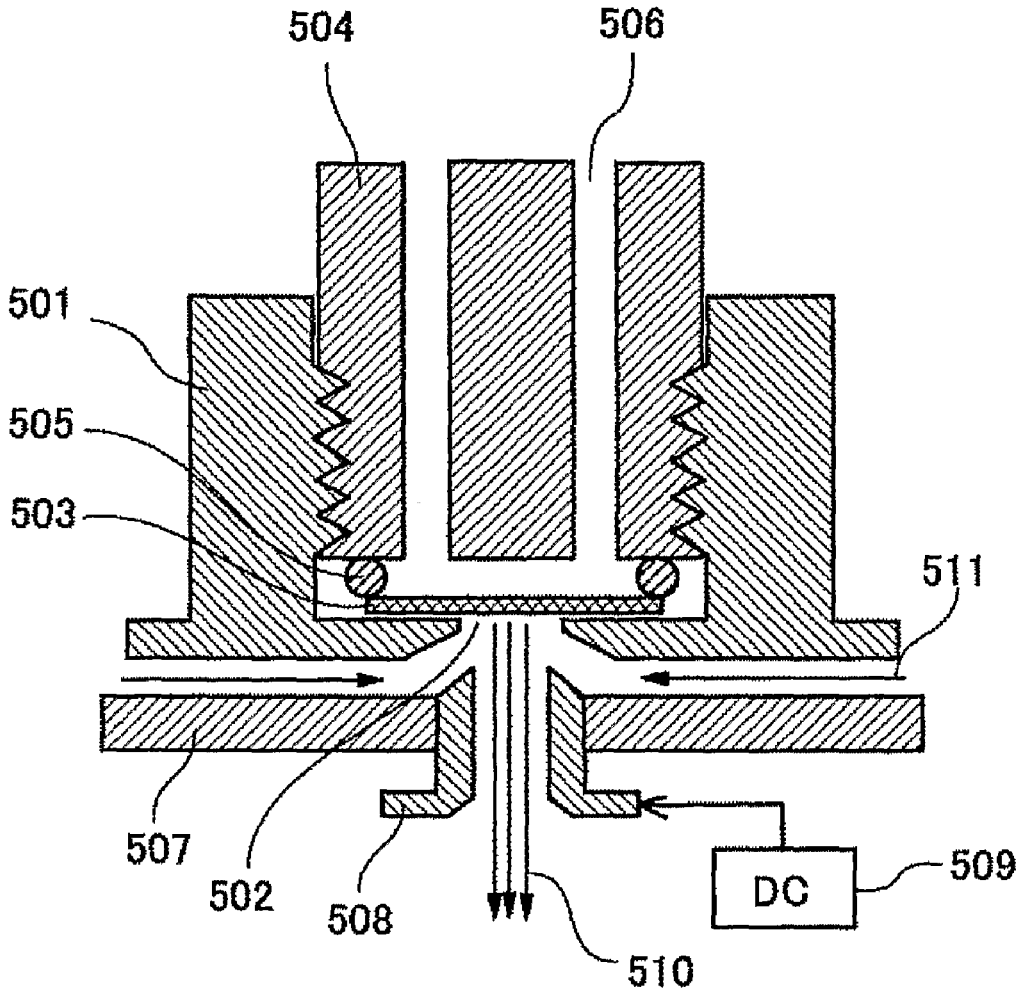
FIG. 1 schematically illustrates the configuration of a liquid droplet forming apparatus employing the vibrating orifice method.

A carrier production method of the present invention includes a step of periodically forming and discharging liquid droplets of a carrier core composition liquid from a plurality of nozzles formed in a thin film, using a liquid droplet forming unit having the thin film and a vibration generating unit configured to vibrate the thin film, a step of forming carrier core particles by solidifying the discharged liquid droplets, and a step of coating the carrier core particles with a resin layer; and, if necessary, further includes other steps.

First Embodiment

A carrier production method of a first embodiment of the present invention includes a step of periodically forming and discharging liquid droplets of a carrier core composition liquid from a plurality of nozzles formed in a thin film, using a liquid droplet forming unit having the thin film and a ring-shaped vibration generating unit disposed in a deformable area of the thin film so as to be along a circumference of the area and to vibrate the thin film, a step of forming carrier core particles by solidifying the discharged liquid droplets, and a step of coating the carrier core particles with a resin layer; and, if necessary, further includes other steps.

Referring now to the schematic configuration shown in FIG. 2, next will be described an embodiment of an apparatus used in the present invention for producing a carrier core, which apparatus is used for carrying out a first embodiment of a production method of the present invention for carrier core particles. The members constituting this apparatus will be described in detail, and a production method for a primarily granulated product will also be described. In this method, magnetic powder, a binder, a dispersant and a defoamer, which form a carrier core, are mixed one another to prepare a slurry. Conveniently, this slurry is referred to as a "carrier core composition liquid."

A carrier core particle production apparatus 1 includes a liquid droplet jetting unit 2, a particle forming section 3 serving as a particle forming unit, a carrier core collecting section 4, a tube 5, a carrier core reservoir 6 serving as a carrier core reserving unit, a material accommodating unit 7 and a pump 9. In this apparatus, the liquid droplet jetting unit 2 includes a liquid droplet forming unit and a reservoir; the particle forming section 3 is disposed below the liquid droplet jetting unit 2 and forms carrier core particles P by solidifying liquid droplets of a carrier core composition liquid 10 which are discharged from the liquid droplet jetting unit 2; the carrier core collecting section 4 collects the carrier core particles P formed in the particle forming section 3; the carrier core reservoir 6 reserves the carrier core particles P transferred via the tube 5 from the carrier core collecting section 4; the material accommodating unit 7 contains the carrier core liquid composition 10; and the pump 9 for pressure-feeding the carrier core composition liquid 10 upon operation of the carrier core production apparatus 1.

Figure 2:
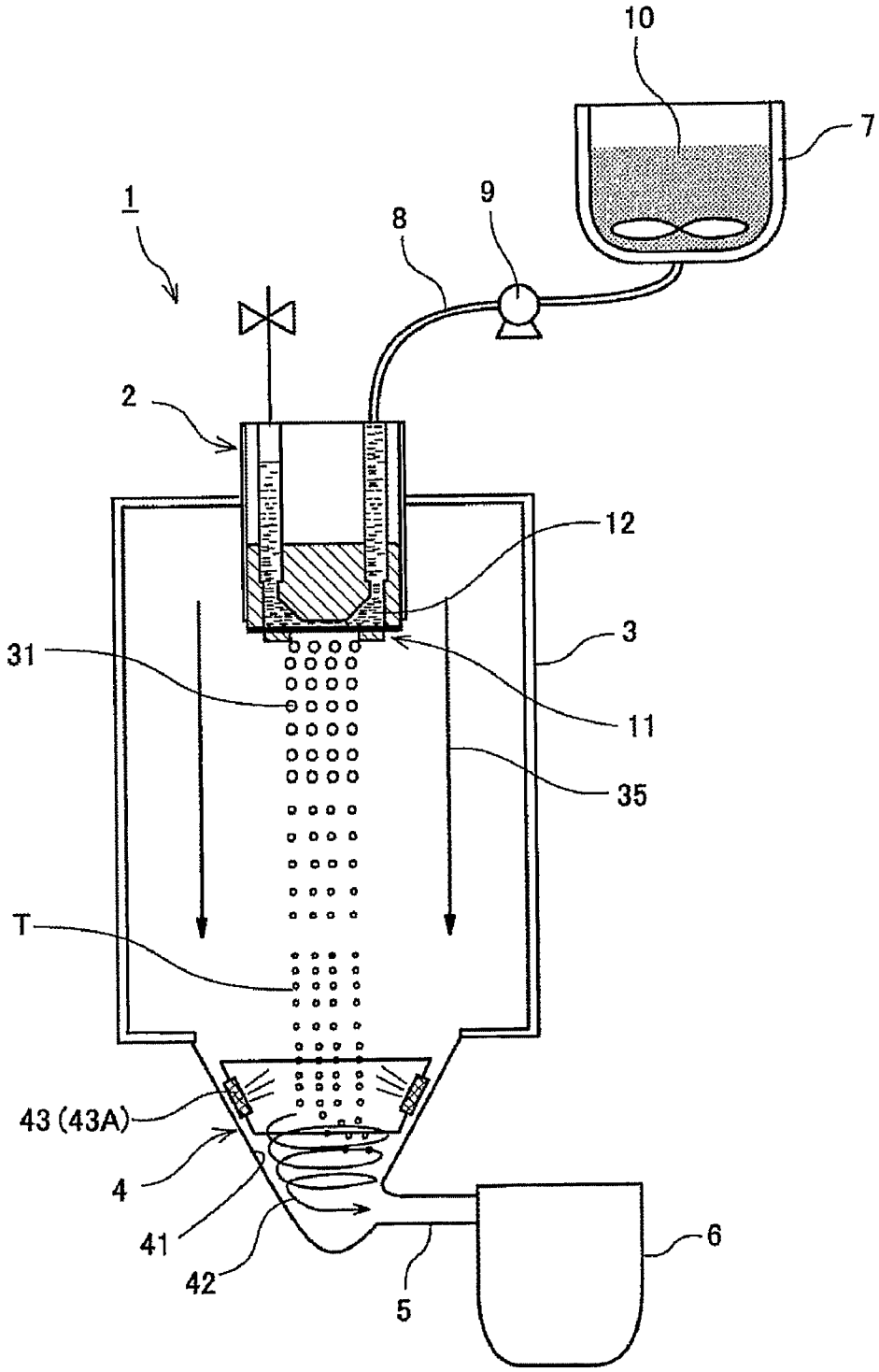
FIG. 2 schematically illustrates an embodiment of a carrier core production apparatus employing a carrier core production method used in the present invention.
Figure 3:
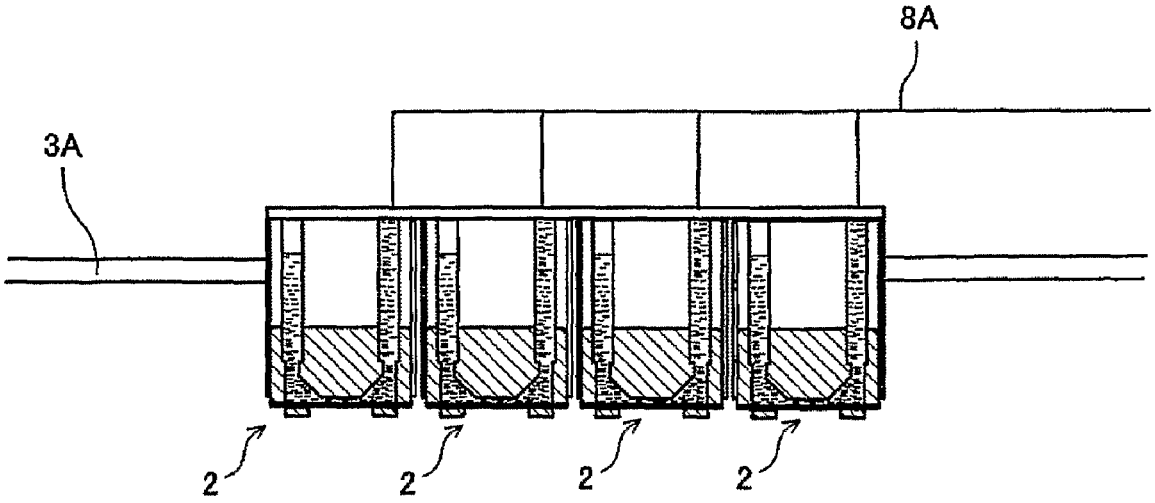
FIG. 3 is an explanatory view of an essential part of the carrier core production apparatus.

FIG. 2 illustrates a carrier core particle production apparatus having one liquid droplet jetting unit 2. Preferably, as shown in FIG. 3, a plurality of liquid droplet jetting units 2 (e.g., 100 to 1,000 liquid droplet jetting units in terms of controllability (in FIG. 3, four liquid droplet jetting units are illustrated)) are disposed in a row to the top surface 3A of the particle forming section 3, and the liquid droplet jetting units 2 each are connected via a pipe 8A to the material accommodating unit 7 (common liquid reservoir) so that the carrier core liquid composition 10 is supplied thereto. With this configuration, a larger number of liquid droplets can be discharged at one time, resulting in improving production efficiency.

During operation of the carrier production apparatus, the carrier core composition liquid 10 sent from the material accommodating unit 7 can be self-supplied to the liquid droplet jetting unit 2 due to the effect of the liquid droplet forming phenomenon brought by the liquid droplet jetting unit 2 and thus, the pump 9 is subsidiarily used for liquid supply. This indicates that liquid droplet formation is caused not by a pressure applied from the pump 9 but by only vibration energy of the liquid droplet jetting unit.

Figure 4:
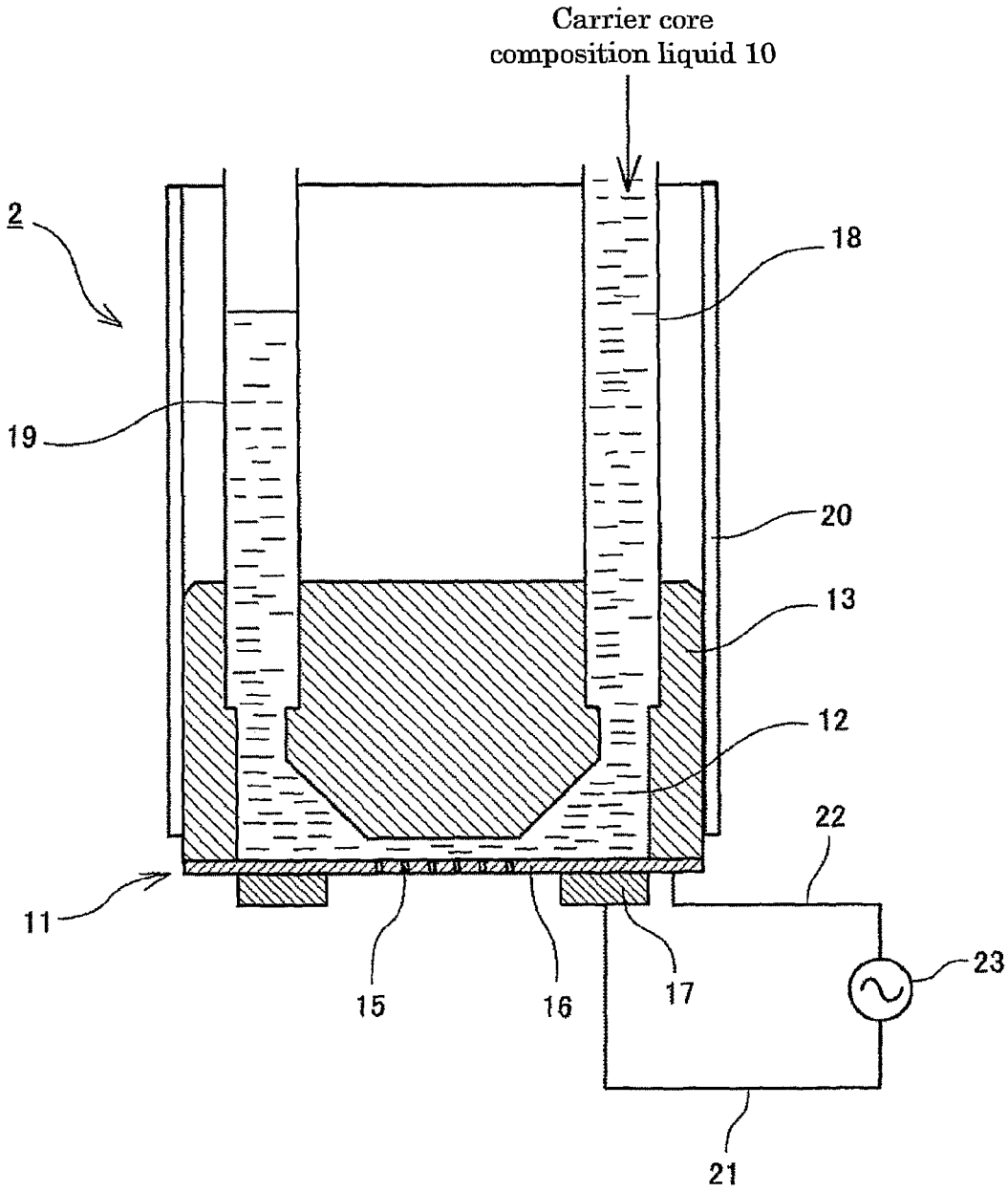
FIG. 4 is an enlarged view of a liquid droplet jetting unit of the carrier core production apparatus.
Figure 5:
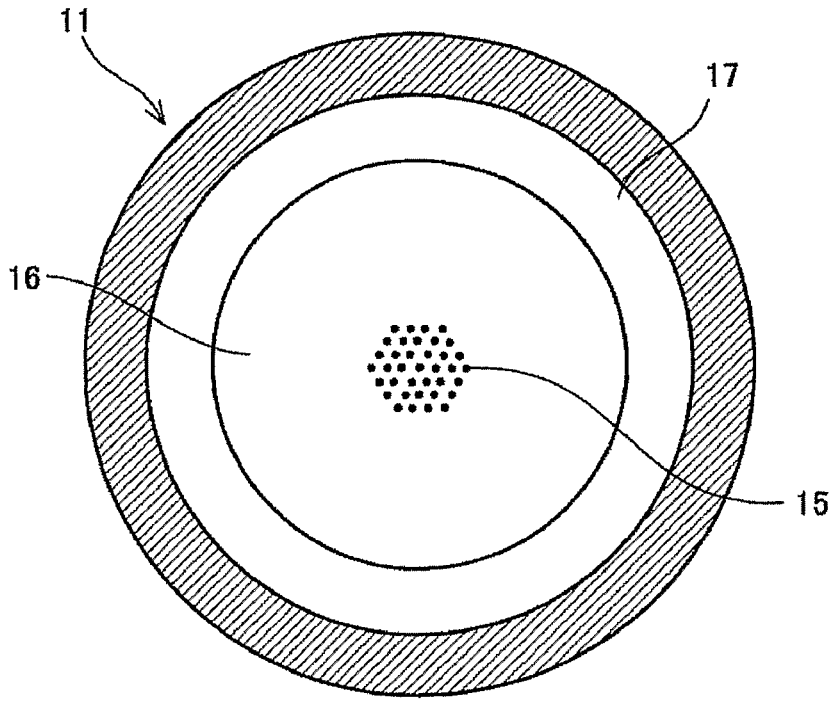
FIG. 5 is a bottom view of the production apparatus shown in FIG. 4, as viewed from the underside.
Figure 6:
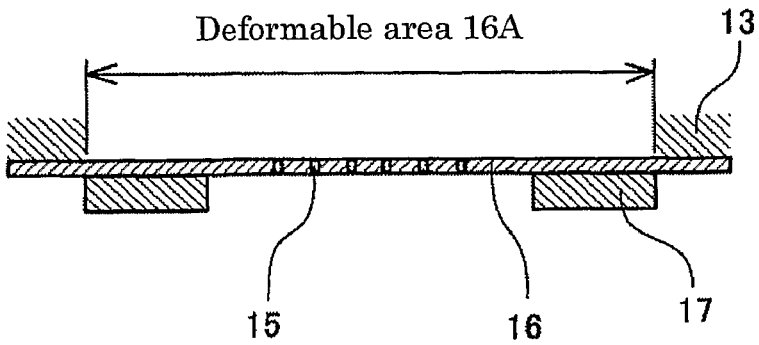
FIG. 6 is an explanatory enlarged view of a liquid droplet forming unit of the liquid droplet jetting unit.

Next will be described the liquid droplet jetting unit 2 with reference to FIGS. 4 to 6. FIG. 4 is an explanatory cross-sectional view of the liquid droplet jetting unit 2; FIG. 5 is a bottom view of the production apparatus shown in FIG. 4, as viewed from the underside; and FIG. 6 is an explanatory schematic cross-sectional of the liquid droplet forming unit.

This liquid droplet jetting unit 2 includes a liquid droplet forming unit 11 and a flow passage member 13, wherein the liquid droplet forming unit 11 is configured to discharge the carrier core composition liquid 10 in a form of liquid droplet, and the flow passage member 13 has a reservoir (flow passage) 12 supplying the carrier core composition liquid 10 to the liquid droplet forming unit 11.

The liquid droplet forming unit 11 has a thin film 16 having a plurality of nozzles (ejection holes) 15 and an electromechanical transducing unit (element) 17 which is a ring-shaped vibration generating unit configured to vibrate the thin film 16. Here, the thin film 16 is joined/fixed at its outermost peripheral area (shaded area in FIG. 5) on the flow passage member 13 with solder or a binder resin. The electromechanical transducing unit 17 is disposed along an inner circumference of a deformable area 16A (i.e., area on which the flow passage member 13 is not fixed) of the thin film 16. The electromechanical transducing unit 17 is connected via lead wires 21 and 22 to a drive circuit (drive signal generating source) 23, and when a drive voltage (drive signal) having a required frequency is applied, it generates, for example, deflection vibration.

The material for forming the thin film 16 is not particularly limited and can be appropriately selected depending on the purpose. Preferably, it is hard materials, more preferably stainless steel and titanium. Also, the shape of the nozzle 15 is not particularly limited and can be appropriately selected depending on the purpose. For example, a truly circular or ellipsoidal nozzle may be suitably used.

Preferably, the thin film 16 is made of a plate of the above metal with a thickness of 5 μm to 100 μm and the nozzle 15 has a pore size of 10 μm to 50 μm. This is because small liquid droplets with a very uniform particle diameter are formed during discharge of the carrier core composition liquid from the nozzle 15. Notably, when the nozzle 15 has a truly circular shape, the pore size is the diameter thereof. When the nozzle 15 has an ellipsoidal shape, the pore size is the minor axis thereof. The number of nozzles 15 is preferably 2 to 3,000. From the viewpoint of improving production efficiency, the number is preferably 100 or more.

The electromechanical transducing unit 17 is not particularly limited, so long as it can assuredly vibrate the thin film 16 at a constant frequency. A bimorph-type piezoelectric element capable of exciting flexural oscillation is preferably used. Examples of the piezoelectric element include piezoelectric ceramics such as lead zirconium titanate (PZT). The piezoelectric ceramics generally exhibit a small displacement and thus, are often used in a form of laminate. Further examples include piezoelectric polymers such as polyvinylidene fluoride (PVDF); quartz crystal; and single crystals such as $LiNbO_3$, $LiTaO_3$ and $KNbO_3$.

A feeding tube 18 for feeding the carrier core composition liquid to the reservoir 12 is connected at one or more sites to the flow passage member 13, and also, an air bubble discharge tube 19 for discharging air bubbles is connected thereto at one or more sites. The flow passage member 13 is disposed via a supporting member 20 to the top surface of the particle forming section 3. FIG. 2 illustrates a carrier core particle production apparatus having a liquid droplet jetting unit 2 at the top surface of the particle forming section 3. Alternatively, the liquid droplet jetting unit 2 may be disposed to the side wall or bottom of the particle forming section 3 (drying section).

Figure 7:
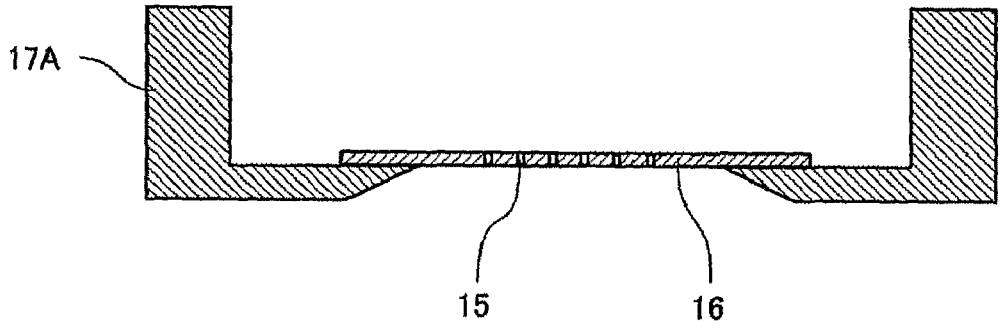
FIG. 7 is an explanatory enlarged view of a comparative liquid droplet forming unit.

As described above, the liquid droplet forming unit 11 includes the thin film 16 having a plurality of nozzles 15 facing the reservoir 12, and the ring-shaped electromechanical transducing unit 17 disposed along an inner circumference of the deformable area 16A of the thin film 16. When the liquid droplet forming unit 11 has such a configuration, as compared with, for example, the comparative configuration shown in FIG. 7 (similar to the configuration shown in FIG. 1) where an electromechanical transducing unit 17A supports the thin film 16 at its peripheral area, the displacement of the thin film 16 is relatively large. With this configuration, a plurality of nozzles 15 can be disposed in a relatively large area (1 mm or greater in diameter) where a large displacement can be obtained and thus, a number of liquid droplets can be reliably discharged at one time from the nozzles 15.

Figure 8A:
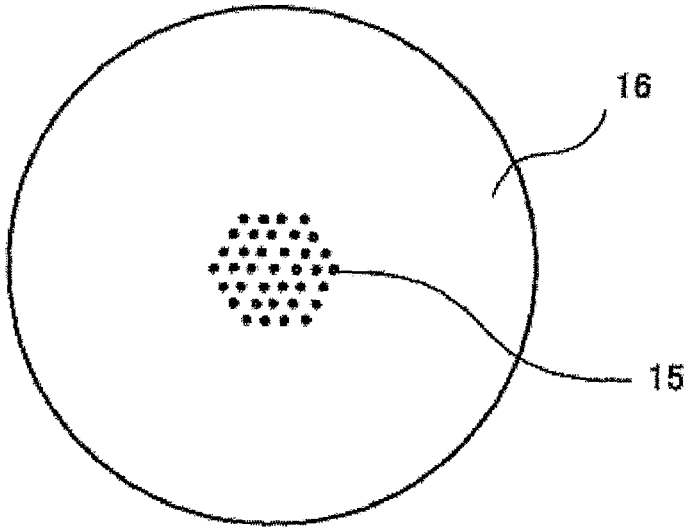
FIG. 8A is a schematic view of a thin film of the liquid droplet forming unit of the liquid droplet jetting unit, which is used for describing the principle of operations of forming liquid droplets.
Figure 8B:
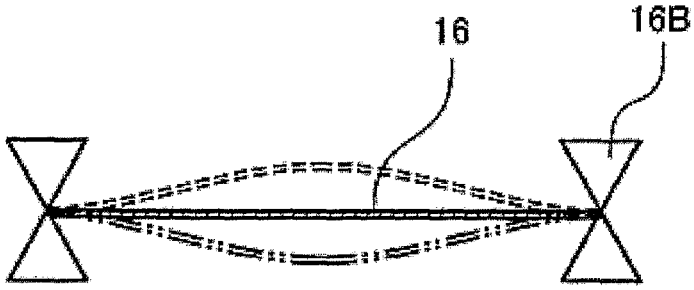
FIG. 8B is a schematic view of a thin film of the liquid droplet forming unit of the liquid droplet jetting unit, which is used for describing the principle of operations of forming liquid droplets.

The principle of operations of the liquid droplet forming unit 11 will be described with reference to FIGS. 8A and 8B. As shown in FIGS. 8A and 8B, when the thin film 16 having a simple round-shape is fixed at its peripheral area 16B (more specifically, the deformable area 16A is fixed at its outer circumference), a basic vibration occurring upon vibrating has a node at the peripheral area. As shown in FIG. 8B (cross-sectional view), the maximum displacement ΔLmax is observed at a center portion O, and the thin film 16 periodically is vibrated in a vertical direction.

Figure 9:
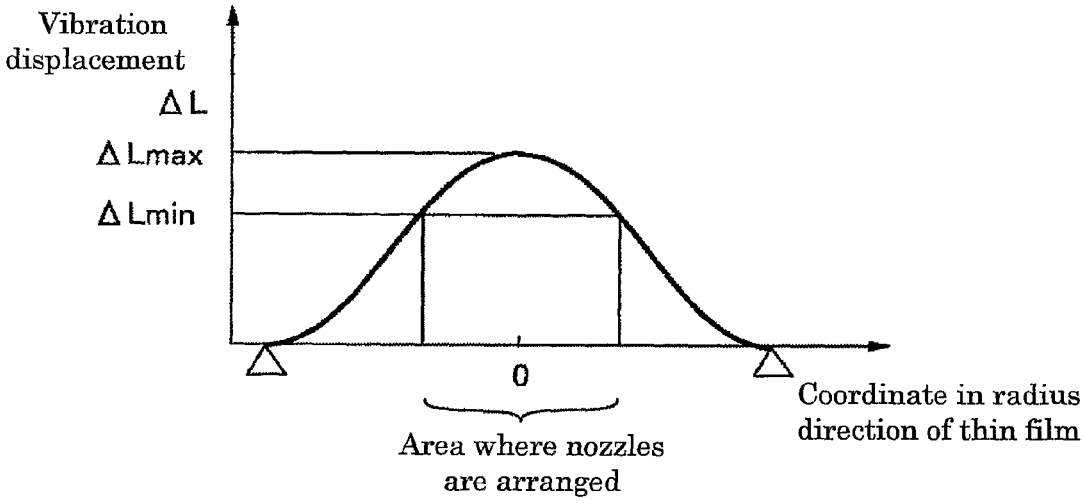
FIG. 9 shows a basic vibration mode in the thin film.
Figure 10:
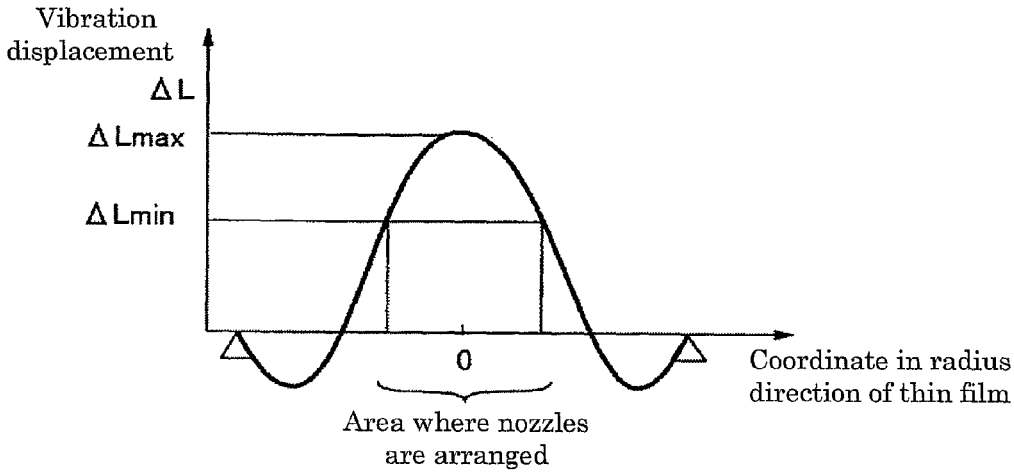
FIG. 10 shows a secondary vibration mode in the thin film.
Figure 11:
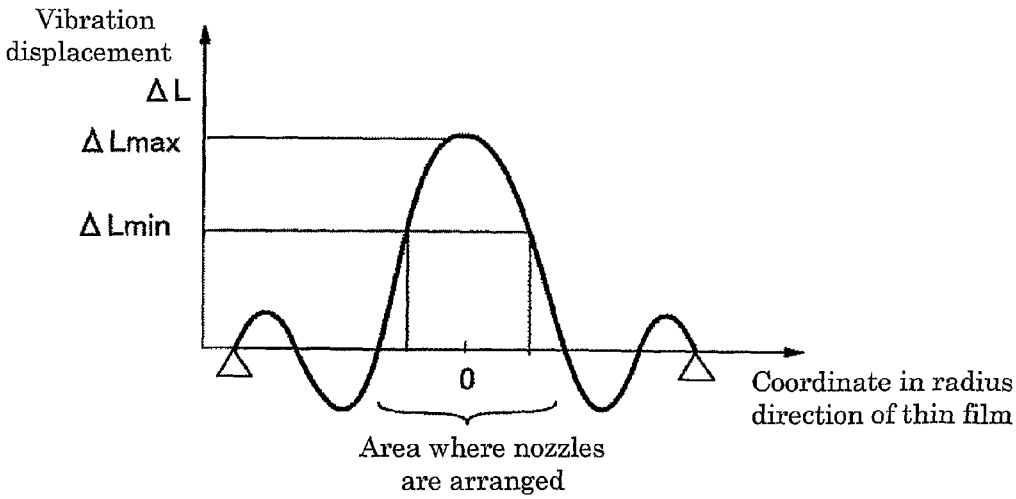
FIG. 11 shows a tertiary vibration mode in the thin film.
Figure 12:
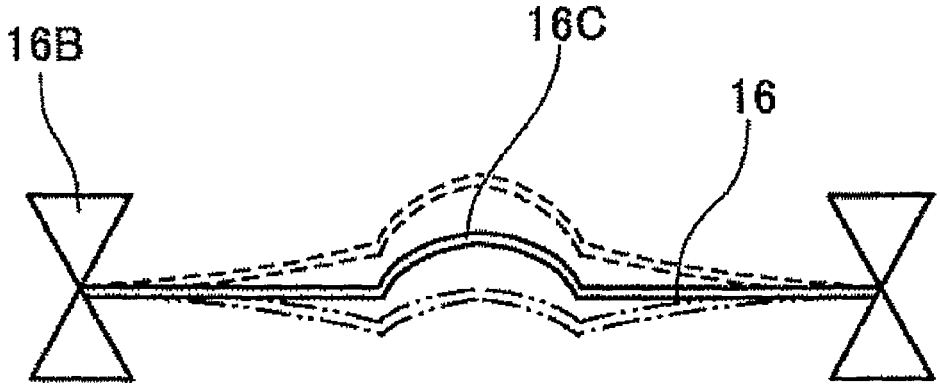
FIG. 12 is an explanatory view of a thin film having a convex portion at its center portion.

As shown in FIG. 9, the thin film 16 is preferably vibrated in a vibration mode where there are no nodes existing diametrically (in a radius direction); i.e., only the peripheral area forms a node. Notably, there have been known higher-order vibration modes shown in FIGS. 10 and 11. In these modes, one or more nodes are concentrically formed in the circular thin film 16, and this thin film substantially transforms radially symmetrically. Also, use of the circular thin film 16 having a convex portion 16C at its center portion (shown in FIG. 12) can control the vibration amplitude and the movement direction of liquid droplets.

When the circular thin film 16 is vibrated, a pressure of Pac is applied to the liquid (carrier core composition liquid) present in the vicinity of the nozzles 15 formed in the thin film. This Pac is proportional to the vibration speed Vm of the thin film 16. This pressure is known to arise as a result of reaction of a radiation impedance Zr of the medium (carrier core composition liquid), and is expressed by multiplying the radiation impedance by a vibration speed of film Vm, as shown in the following Equation (1).

$$Pa(r,t)=Zr*Vm(r,t) \quad (1)$$

The vibration speed Vm of the thin film 16 periodically varies with time (i.e., a function of time) and may form various periodic variations (e.g., a sine waveform and rectangular waveform). Also, as described above, the vibration displacement in a vibration direction varies depending on a position in the thin film 16; i.e., the vibration speed Vm is also a function of a position. Preferable vibration forms of the thin film used in the present invention is radially symmetric, as mentioned above. Thus, the vibration form is virtually a function of a radial coordinate.

The carrier core composition liquid 10 in the reservoir 12 is discharged to a gaseous phase by the action of the pressure periodically changing proportional to the position-dependent vibration speed of the thin film 16. Then, the carrier core composition liquid 10, which has been periodically discharged to the gaseous phase, becomes spherical attributed to the difference in surface tension between in the liquid phase and in the gaseous phase, periodically forming and discharging liquid droplets. As a result, the carrier core composition liquid 10 is discharged from nozzles 15 in a form of liquid droplet.

Figure 13A:
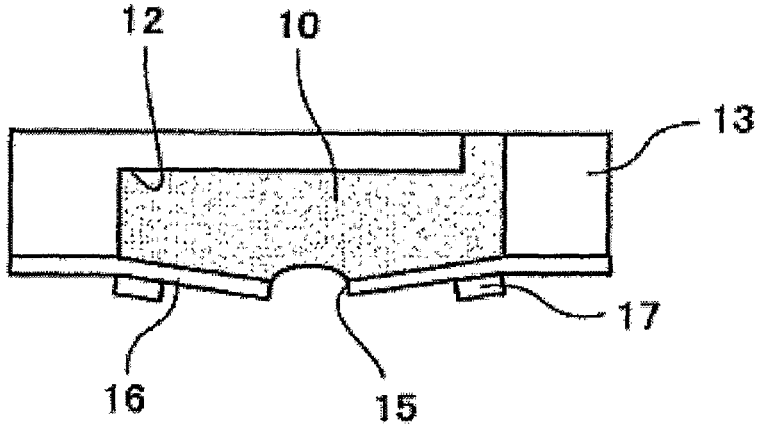
FIG. 13A is an explanatory schematic view of the liquid droplet forming unit, which is used for describing the principle of operations of forming liquid droplets.
Figure 13B:
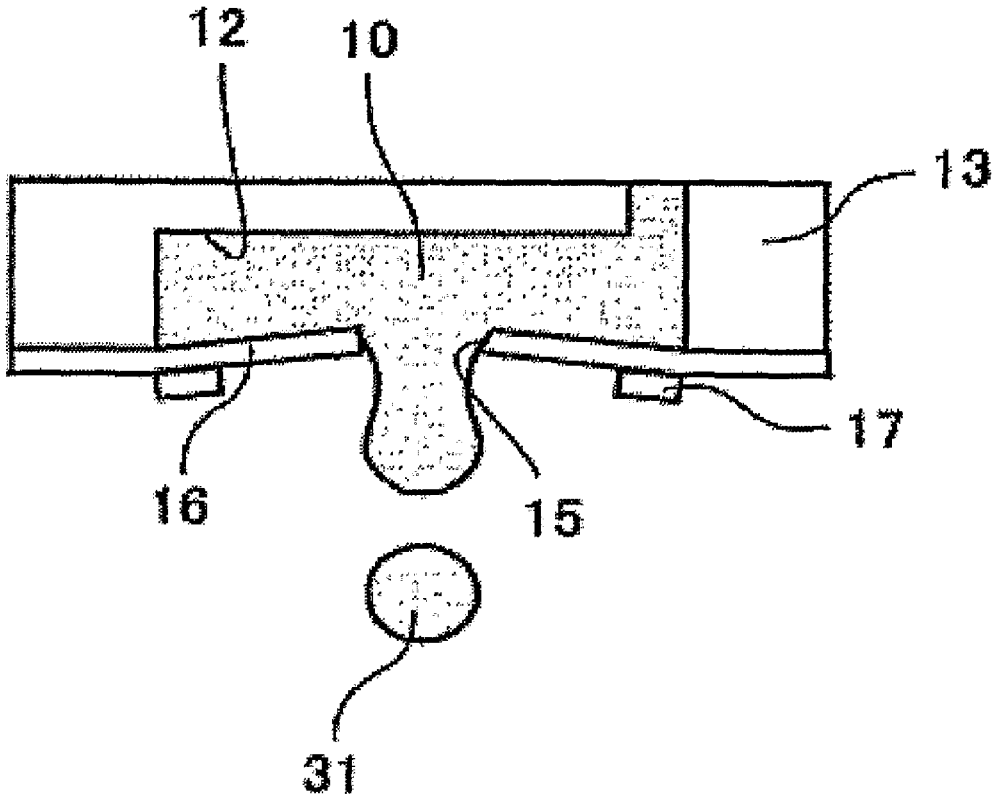
FIG. 13B is an explanatory schematic view of the liquid droplet forming unit, which is used for describing the principle of operations of forming liquid droplets.

The above is schematically shown in FIGS. 13A and 13B. Specifically, when vibrated with the electromechanical transducing unit 17 disposed along an inner circumference of the deformable area 16A, the thin film 16 is alternatingly deflected toward the gaseous phase (shown in FIG. 13A) and toward the reservoir 12 (shown in FIG. 13B). This vibration of the thin film 16 causes the carrier core composition liquid 10 to be jetted (discharged) as liquid droplets 31.

In order to form liquid droplets, the thin film 16 may be vibrated at a vibration frequency of 20 kHz to 2.0 MHz. For producing carrier particles, it is preferably vibrated at a vibration frequency of 20 kHz to 300 kHz.

When the vibration frequency is 20 kHz or higher, dispersibility of magnetic particles contained in the carrier core composition liquid 10 is promoted through excitation of the liquid composition. Also, when the thin film is vibrated within the above vibration frequency range, no aggregates of magnetic particles used are generated, avoiding nozzle clogging. Further, even if aggregates are generated to cause nozzle clogging, the aggregates are immediately divided into individual particles again in the nozzles, spontaneously causing nozzle unclogging. The above-described phenomena are thought to reasonably occur in consideration of the particle diameter of the magnetic powder used and the above vibration frequency range which is the same as employed in so-called ultrasonic wave dispersers. Also, when foreign matter (e.g., dust) contaminates the production processes or raw materials, some foreign matter larger than the nozzle cannot be passed through it and is discharged through liquid circulation; and other foreign matter slightly smaller than the nozzle can be spontaneously (similar to the above) removed through jetting from it. The granulation method employing vibrating orifices or ink jetting, in which method a carrier core composition liquid is fed in one direction with a pump, does not have the above-described advantageous features. The production method of the present invention can achieve very reliable liquid droplet formation.

The larger the vibration displacement in an area of the thin film 16 which area has nozzles 15, the larger the diameter of the liquid droplets 31. When the vibration displacement is small, the formed liquid droplets are small or no liquid droplets are formed. In order to reduce variation in size of the liquid droplets, the nozzles 15 must be formed in optimal positions determined in consideration of the vibration displacement of the thin film 16.

From the results of experiments, the present inventors have found that in the case where the thin film 16 is vibrated with the electromechanical transducing unit 17, when nozzles 15 are formed within an area where the ratio R (ΔLmax/ΔLmin) of the maximum vibration displacement ΔLmax to the minimum vibration displacement ΔLmin is 2.0 or lower (shown in FIGS. 9 to 11), variation in size of the liquid droplets is reduced to such an extent that the formed carrier particles can provide a high quality image.

Referring to FIG. 2 again, next will be described the particle forming section 3 in which the liquid droplets 31 of the carrier core composition liquid 10 are solidified to form carrier core particles P.

As described above, the carrier core composition liquid 10 is a solution or slurry prepared by dispersing, in a solvent (e.g., water), a carrier composition containing at least magnetic powder and a binder which form carrier core particles. Thus, in this chamber, the liquid droplets 31 are dried through water evaporation to form carrier core particles P. That is, in this embodiment, the particle forming section 3 serves also as a solvent removal section where the liquid droplets 31 are dried through solvent removal to form carrier core particles P (hereinafter the particle forming section 3 may be referred to as a "solvent removal section" or "drying section").

Specifically, in this particle forming section 3, the liquid droplets 31 which have been discharged from the nozzles 15 of the liquid droplet jetting unit 2 are conveyed with dry gas 35 flowing in a direction in which the liquid droplets 31 flow, to thereby remove the solvent (water) of the liquid droplets 31 to form carrier core particles P. The dry gas 35 is not particularly limited, so long as it can dry the liquid droplets 31. Examples thereof include air and nitrogen.

Next will be described a carrier core collecting section (carrier core collecting unit) 4 for collecting the carrier core particles P provided in the particle forming section 3.

The carrier core collecting section 4 is continuously formed subsequent to the particle forming section 3 so as to receive the flowing particles, and has a tapered surface 41 in which the pore size gradually decreases from the inlet (the side closer to the liquid droplet jetting unit 2) toward the outlet. In this configuration, the carrier core particles P are collected in the carrier core collecting section 4 by the action of air flow (vortex flow) 42 flowing downstream of this part, the air flow 42 being generated by sucking inside the carrier core collecting section 4 with an unillustrated suction pump. In this manner, using a centrifugal force of vortex flow (air flow 42), the carrier core particles P can be assuredly collected and then transferred to the carrier core reservoir 6 provided downstream.

Figure 14:
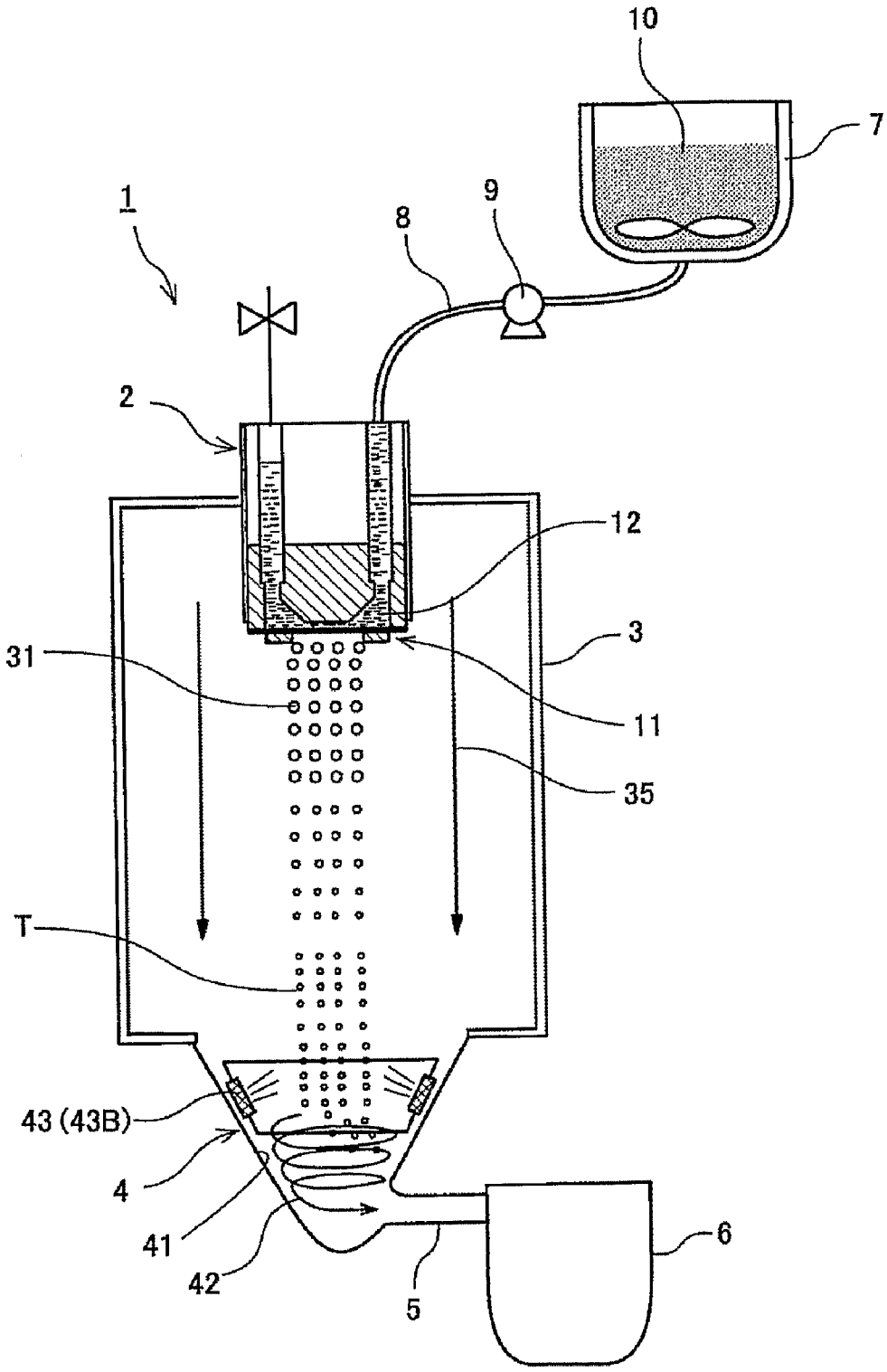
FIG. 14 schematically illustrates another embodiment of the carrier core production apparatus.

Also, a charge eliminating unit 43 is provided in the vicinity of the inlet of the carrier core collecting section 4, and temporarily neutralizes (eliminates) charges of the carrier core particles P formed in the particle forming section 3. In FIG. 2, the charge eliminating unit 43 employs a soft X-ray irradiator 43A for irradiating the carrier core particles P with a soft X-ray. Alternatively, as shown in FIG. 14, the charge eliminating unit 43 may employ a plasma irradiator 43B for irradiating the carrier core particles P with plasma. Also, when the formed carrier core particles P have low charging amount, such a charge eliminating unit is not needed; i.e., is an optionally used device.

The carrier core particles P, which have been collected in the carrier core collecting section 4, are transferred via the tube 5 to the carrier core reservoir 6 by the action of vortex flow (air flow 42). When the carrier core collecting section 4, tube 5 and carrier core reservoir 6 are made of a conductive material, these are preferably connected to the ground (earth) in terms of safety. In addition, the formed carrier core particles P may be pressure-fed from the carrier core collecting section 4 to the carrier core reservoir 6 or may be sucked from the carrier core reservoir 6.

Next will be roughly described a production method for the carrier core of the present invention using the carrier core production apparatus 1 having such a configuration.

The carrier core composition liquid 10 containing at least the carrier composition in a dispersed state is fed to the reservoir 12 of the liquid droplet jetting unit 2. While maintaining this state, a drive signal having a required drive frequency is applied to the electromechanical transducing unit 17 of the droplet forming unit 11 to generate deflection vibration. The thin film 16 is periodically vibrated by the action of the thus-generated deflection vibration. The carrier core composition liquid 10 supplied from the reservoir 12 is periodically discharged in a form of liquid droplet from a plurality of nozzles 15 formed in the thin film 16. The formed liquid droplets 31 are released to the interior of the particle forming section 3 (see FIG. 2) serving as a solvent removal section.

The liquid droplets 31 flowing in the particle forming section 3 are conveyed with dry gas 35 flowing in a direction in which the liquid droplets 31 flow, to thereby remove the solvent thereof to form carrier core particles P. The carrier core particles P formed in the particle forming section 3 are collected by the action of air flow 42 into the carrier core collecting section 4 provided downstream, and then transferred via the tube 5 to the carrier core reservoir 6.

As described above, a plurality of nozzles 15 are provided in the liquid droplet forming unit 11 of the liquid droplet jetting unit 2 and therefore, the carrier core composition liquid is discharged simultaneously from the nozzles to form a large number of the liquid droplets 31 in a continuous manner, resulting in remarkably improving production efficiency of carrier core particles. Also, as described above, the liquid droplet forming unit 11 has a thin film 16 having a plurality of nozzles 15 facing the reservoir 12 and the ring-shaped electromechanical transducing unit 17 disposed along an inner circumference of the deformable area 16A of the thin film 16. Therefore, the nozzles 15 are formed in the thin film 16 where a large displacement can be obtained and thus a number of liquid droplets 31 can be reliably discharged at one time from the nozzles 15 without clogging, attaining reliable, efficient production of carrier core particles. Furthermore, the carrier core particles formed by this method were found to have a monodisperse particle distribution, which had not conventionally been attained.

Second Embodiment

A carrier production method of a second embodiment the present invention includes a step of periodically forming and discharging liquid droplets of a carrier core composition liquid from a plurality of nozzles formed in a thin film, using a liquid droplet forming unit including a vibration amplifying unit which is configured to amplify a vibration generated from a vibration generating unit and which has a vibration applying surface for applying the vibration to a target, the vibration applying surface being disposed so as to face the thin film, and a liquid feeding unit configured to feed the carrier core composition liquid to a space between the vibration applying surface and the thin film, while changing the hydraulic pressure of the carrier core composition liquid present between the vibration applying surface and the thin film to repeatedly vibrate the flexible thin film in a thickness direction in a flexural manner, a step of forming carrier core particles by solidifying the discharged liquid droplets and a step of coating; and, if necessary, further includes other steps.

Figure 15:
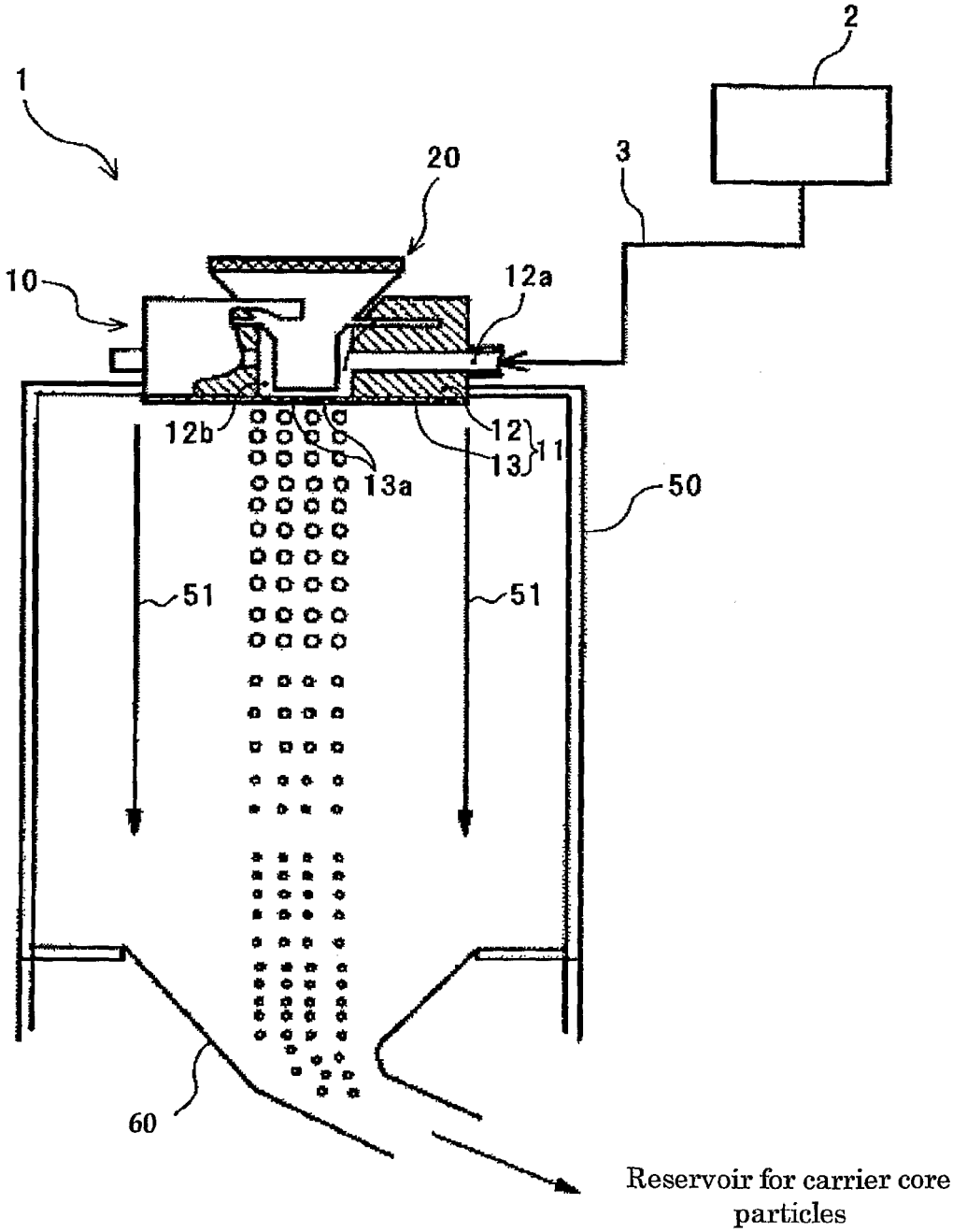
FIG. 15 schematically illustrates a carrier particle production apparatus used in the carrier core production method.

FIG. 15 schematically illustrates a particle production apparatus 1 used in a second embodiment of the present invention. This particle production apparatus includes a raw material tank 2, a liquid droplet jetting nozzle 10, a particle forming section 50 and a particle collecting section 60.

The raw material tank 2 contains a carrier core composition liquid which has been prepared by melting raw materials for carrier core particles or by dispersing or dissolving them in a solvent. This raw material tank 2 is provided at a higher level than the liquid droplet jetting nozzle 10 and is connected via a pipe 3 to the liquid droplet jetting nozzle 10. The carrier core composition liquid contained in the raw material tank 2 is spontaneously fed to the liquid droplet jetting nozzle 10. This liquid droplet jetting nozzle 10 is fixed on the upper wall of the hollow-cylindrical particle forming section 50, and discharges liquid droplets of the carrier core composition liquid from below-described nozzles (ejection holes) toward the interior of the particle forming section 50 provided downwardly in a vertical direction. The thus-discharged liquid droplets are solidified in short time within the particle forming section 50 and then fall as particles.

The particle forming section 50 is provided at its bottom portion with a tapered particle collecting section 60. The particles formed in the particle forming section 50 fall into the particle collecting section 60, and are transferred to an unillustrated carrier core particle reservoir. Also, the liquid droplet jetting nozzle 10 may be fixed on the upper wall (shown in FIG. 15), the side wall or the bottom portion of the particle forming section 50.

Figure 16:
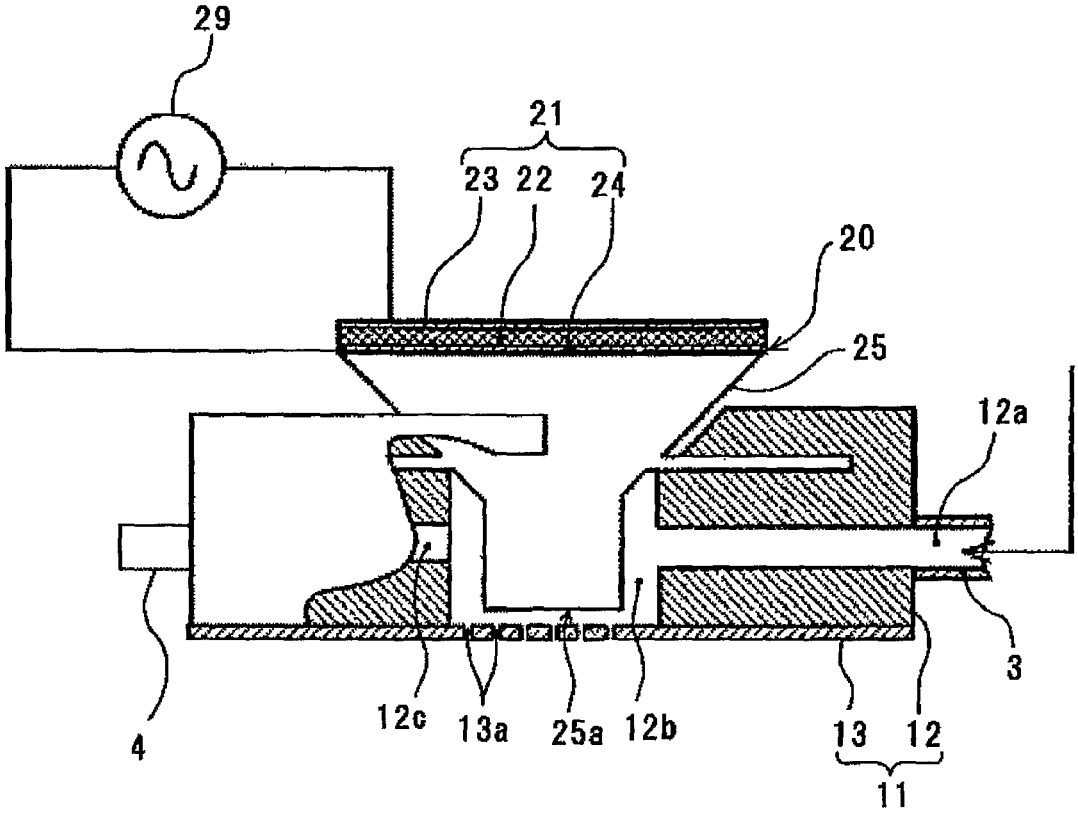
FIG. 16 is an enlarged view of a liquid droplet jetting nozzle of the carrier particle production apparatus.
Figure 17:
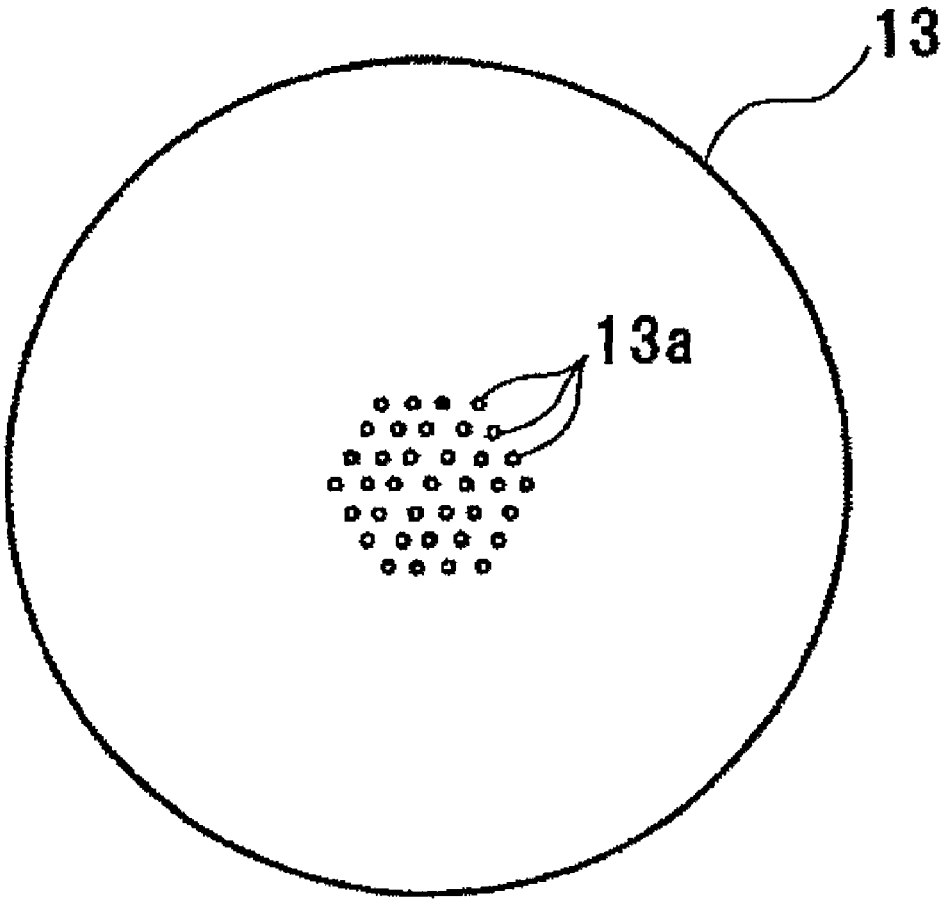
FIG. 17 is an enlarged plan view of a thin film of the liquid droplet jetting nozzle.

FIG. 16 is an enlarged view of the configuration of the liquid droplet jetting nozzle 10. FIG. 17 is an enlarged plan view of the thin film 13 of the liquid droplet jetting nozzle 10. This liquid droplet jetting nozzle 10 includes a liquid accommodating section 11 and a vibration generating unit 20. This liquid accommodating section 11 has a main body 12 and the thin film 13. This main body 12 has a receiving flow passage 12*a* for receiving the carrier core composition liquid which is fed via the pipe 3 to the liquid droplet jetting nozzle 10 from the unillustrated raw material tank, and a hollow-cylindrical accommodating space 12*b* for accommodating the carrier core composition liquid. The thin film 13 serves as the bottom wall of the accommodating space 12*b* of the main body 12. In this configuration, the carrier core composition liquid which has been spontaneously fed into the liquid droplet jetting nozzle 10 is passed through the receiving flow passage 12*a* and then the hollow-cylindrical accommodating space 12*b* to reach the thin film 13. The vibration generating unit 20 is fixed on the side wall of the main body 12 of the liquid accommodating section 11 so as to face the thin film 13 via the carrier core composition liquid accommodated in the hollow-cylindrical accommodating space 12*b*.

The thin film 13 having nozzles (ejection holes) 13*a* is joined/fixed at its circumference on the main body 12 with solder or a binder resin insoluble in the carrier core composition liquid. The material for forming the thin film 13 is not particularly limited and can be appropriately selected depending on the purpose. Also, the shape of the ejection holes 13*a* is not particularly limited and can be appropriately selected depending on the purpose. For example, the thin film 13 is a metal plate with a thickness of 5 μm to 500 μm and the ejection holes have a pore size of 3 μm to 35 μm. The pore size is preferably adjusted to fall within this range, since small liquid droplets with a very uniform particle diameter are formed during discharge of the carrier core composition liquid from the ejection holes 13*a*. Notably, when the ejection holes 13*a* have a truly circular shape, the pore size is the diameter thereof. When the ejection holes 13*a* have an ellipsoidal shape, the pore size is the minor axis thereof. The number of the ejection holes 13*a* is preferably 2 to 3,000.

The vibration generating unit 20 has an excitation section 21 for generating vibration and an amplification section 25 for amplifying the vibration generated in the excitation section 21. The excitation section 21 has an insulating plate 22, a first electrode 23 and a second electrode 24, these electrodes 23 and 24 being fixed on the front and back surfaces, respectively. The difference in potential is periodically caused between these electrodes by pulse signals transmitted from a drive pulse signal generating unit 29, resulting in generating vibration in the excitation section 21. The thus-generated vibration is amplified in the amplification section 25.

The amplification section 25 has a vibration applying surface 25*a* for applying the amplified vibration to a target. This vibration applying surface 25*a* is provided so as to face the thin film 13 via the carrier core composition liquid. When the vibration applying surface 25*a* of the amplification section 25 is vibrated to a considerable extent, the vibration is transmitted via the carrier core composition liquid to the thin film 13 for vibration.

The excitation section 21 is not particularly limited, so long as it can assuredly vibrate the thin film 13 at a constant frequency in a vertical direction (in a thickness direction), and can be appropriately selected depending on the purpose. From the viewpoint of vibrating the thin film 13, a bimorph-type piezoelectric element capable of generating deflection vibration is preferably used in the excitation section 21. Notably, a piezoelectric element can convert electrical energy to mechanical energy. The bimorph-type piezoelectric element can generate a deflection vibration to vibrate the thin film 13 through application of a voltage.

Examples of the piezoelectric element constituting the excitation section 21 include piezoelectric ceramics such as lead zirconium titanate (PZT). The piezoelectric ceramics generally exhibit a small displacement and thus, are preferably used in a form of laminate. Further examples include piezoelectric polymers such as polyvinylidene fluoride (PVDF); quartz crystal; and single crystals such as $LiNbO_3$, $LiTaO_3$ and $KNbO_3$.

The excitation section 21 is arranged in any manner, so long as it can vibrate the thin film 13 having ejection holes 13*a* in a vertical (thickness) direction. It is important that the vibration applying surface 25*a* of the amplification section 25 is set to be in parallel with the thin film 13.

Examples of commercially available products of the vibration generating unit 20, which has the excitation section 21 and the amplification section 25, include a horn vibrator. The horn vibrator amplifies a vibration generated from the excitation section 21 (e.g., piezoelectric element) using the amplification section 25 having a horn shape. When the vibration generating unit 20 has the amplification section 25, the vibration generated by the excitation section 21 can be small and thus, the mechanical load can be reduced, resulting in extending the service life of the production apparatus.

Figure 18:
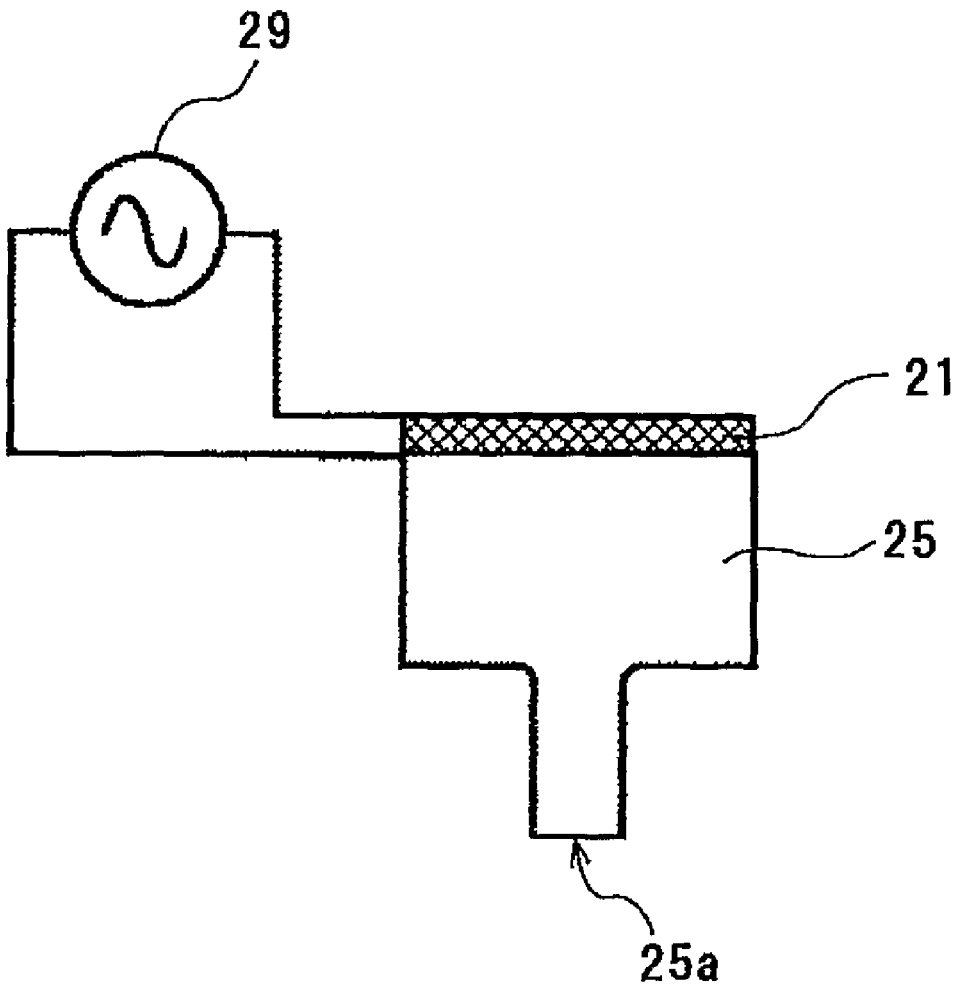
FIG. 18 is an enlarged view of a step-shaped vibration generating unit.
Figure 19:
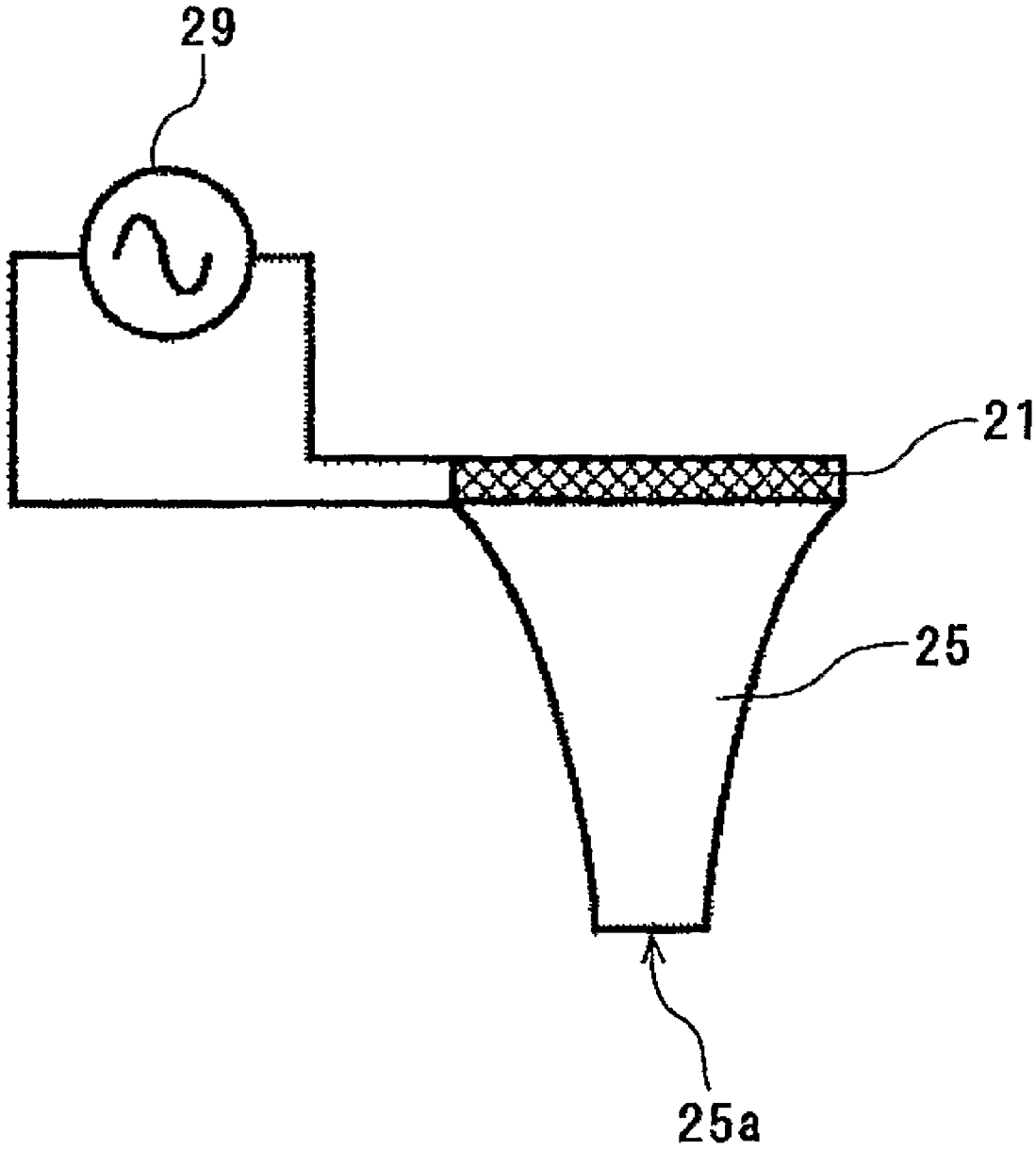
FIG. 19 is an enlarged view of an exponential-shaped vibration generating unit.
Figure 20:
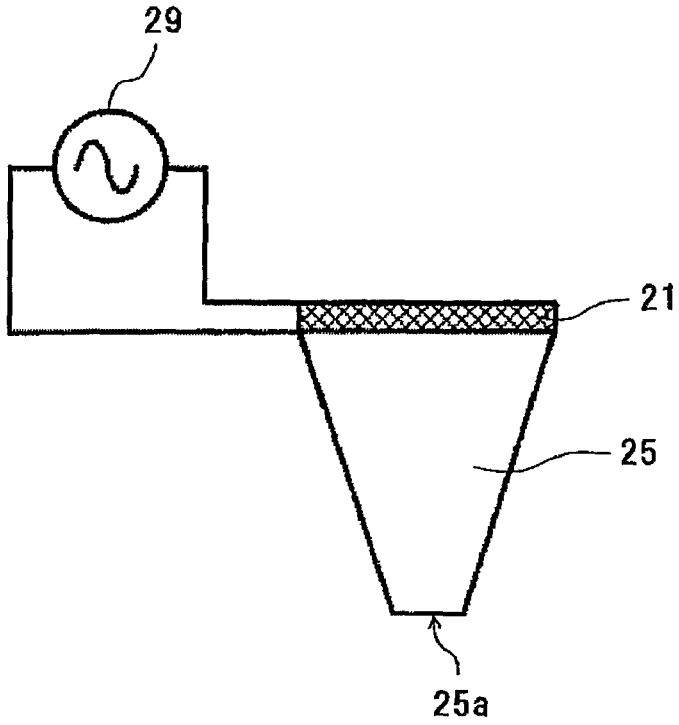
FIG. 20 is an enlarged view of a conical vibration generating unit.

Examples of the horn vibrator include those having a generally known shape. Specific examples include step-horn vibrators (shown in FIG. 18), exponential-horn vibrators (shown in FIG. 19) and conical vibrators (shown in FIG. 20). In these horn vibrators, the excitation section (piezoelectric element) 21 is fixed on a larger surface of the amplification section 25. The vertical vibration generated by this excitation section 21 is amplified as transmitted toward a smaller surface. The amplification section 25 is designed so that the vibration amplified is the greatest at the vibration applying surface 25*a*.

Furthermore, as the vibration generating unit 20, there can be used a bolting Langevin transducer having particularly high mechanical strength. The bolting Langevin transducer has a mechanically connected piezoelectric ceramics and thus, is not broken during excitation of a high-amplitude vibration.

In FIG. 16, to the hollow-cylindrical accommodating space 12*b* are connected an air bubble discharge flow passage 12*c* and the above-described receiving flow passage 12*a* for introducing the carrier core composition liquid from the raw material tank 2. This air bubble discharge flow passage 12*c* is connected to an air bubble discharge tube 4 from the exterior of the liquid accommodating section 11.

The thin film 13 is fixed so that the surface thereof is perpendicular to a direction in which a vibration from the vibration applying surface 25*a* of the amplification section 25 is transmitted through the carrier core composition liquid. Also, a drive pulse signal is transmitted from the drive pulse signal generating unit 29 via a signal transmission unit (e.g., lead wire whose surface has undergone insulating coating) to the excitation section 21 of the vibration generating unit 20.

In general, the size of the excitation section 21 becomes larger with decreasing of the number of vibrations generated. Also, it may be perforated depending on a vibration frequency required. Further, the whole liquid accommodating section 11 can be efficiently vibrated using the excitation section 21. Here, the vibration applying surface is defined as a surface of the amplification section 25 to which surface the thin film 13 having ejection holes 13*a* faces.

Next will be described a mechanism of liquid droplet discharge performed in the liquid droplet jetting nozzle 10. As described above, in the liquid droplet jetting nozzle 10, a vibration generated in the vibration generating unit 20 is applied to the thin film 20 receiving the carrier core composition liquid accommodated in the accommodating space 12*b* of the liquid accommodating section 11, to thereby periodically vibrate the thin film 13 in a thickness direction. The thin film 13 has a plurality of ejection holes 13*a* over a relatively large area (diameter: 1 mm or more) and each of the ejection holes 13*a* can discharge liquid droplets.

Figure 21:
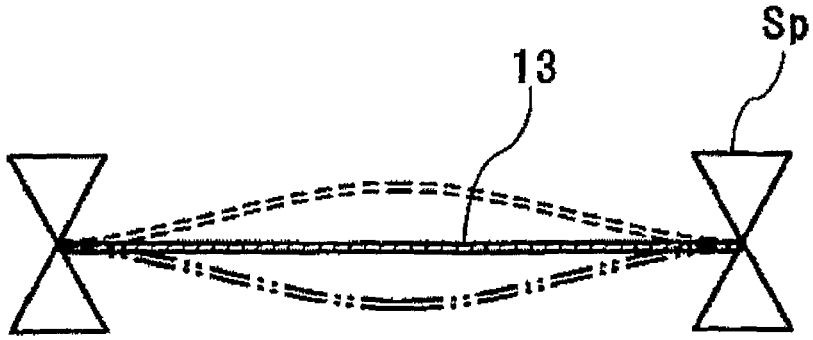
FIG. 21 schematically illustrates a vibrating thin film.
Figure 22:
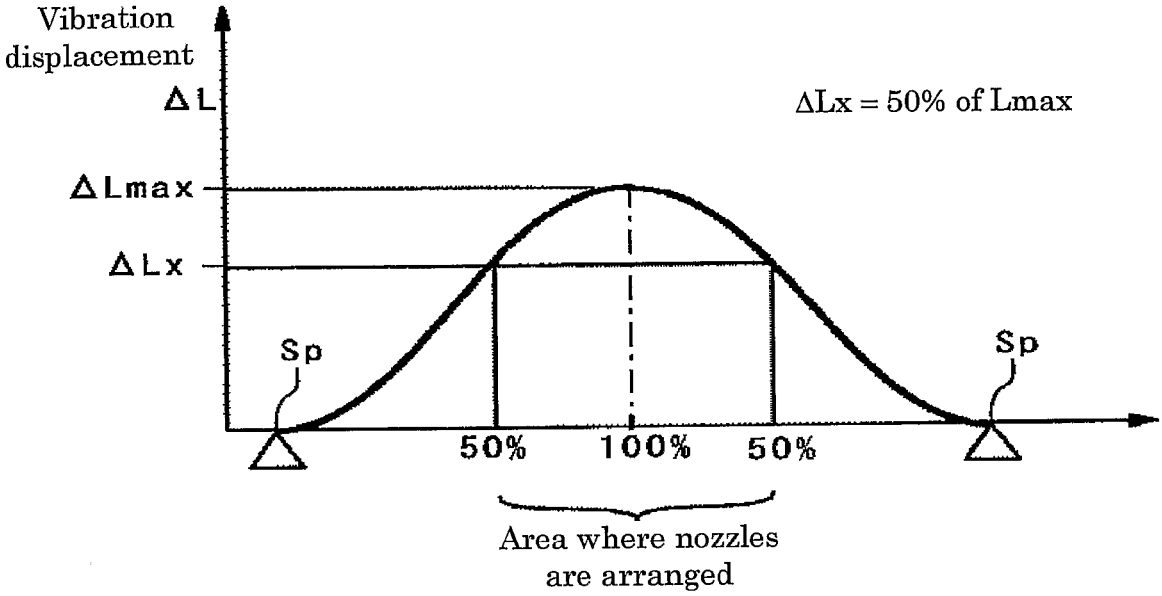
FIG. 22 is a graph of a displacement of the vibrating thin film vs. a position in the thin film.

As shown in FIG. 21, the thin film 13 is vibrated in a thickness direction with respect to a circumference fixing portion Sp serving as a fulcrum (node). FIG. 22 shows a graph of a position in the thin film 13 vs. a displacement (deflection amount) in an upward or downward direction with respect to the circumference fulcrum (shown in FIG. 21). The maximum displacement ΔLmax is observed at a center portion in the thin film, and the displacement ΔL gradually decreases from the center portion in the thin film 13 to the circumference fixing portion Sp. A plurality of ejection holes 13*a* are formed in the thin film 13 so as to be arranged within an area which is around a center where the maximum displacement ΔLmax is observed and in which the displacement ΔL is equal to or higher than 50% of the maximum displacement ΔLmax. In this area, the deviation of the displacement ΔL becomes 2.0 or lower.

Figure 23:
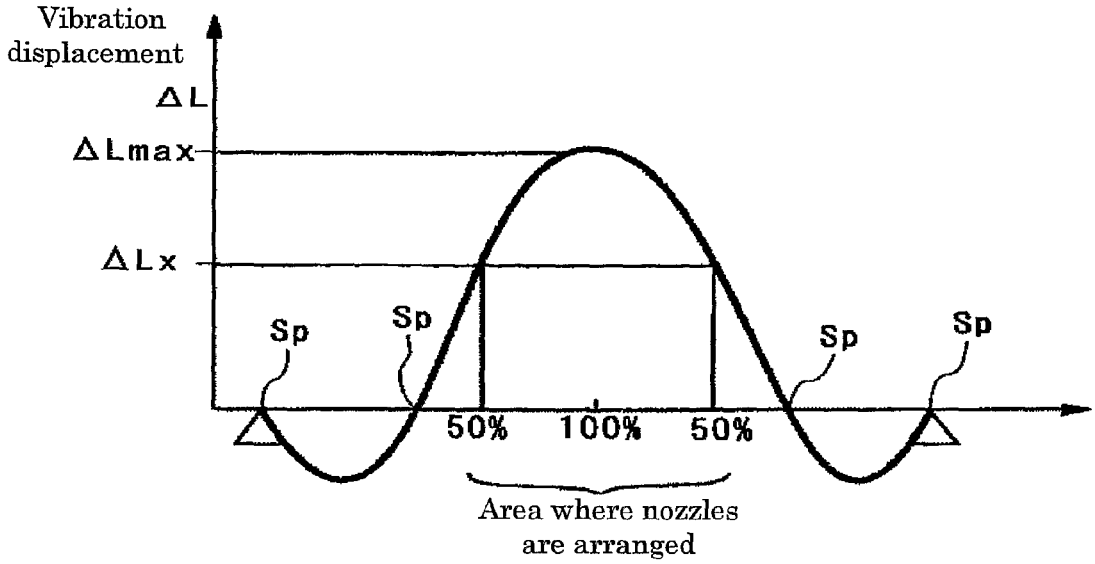
FIG. 23 is a graph of a displacement of the thin film vibrating in a multi-node mode vs. a position in the thin film.
Figure 24:
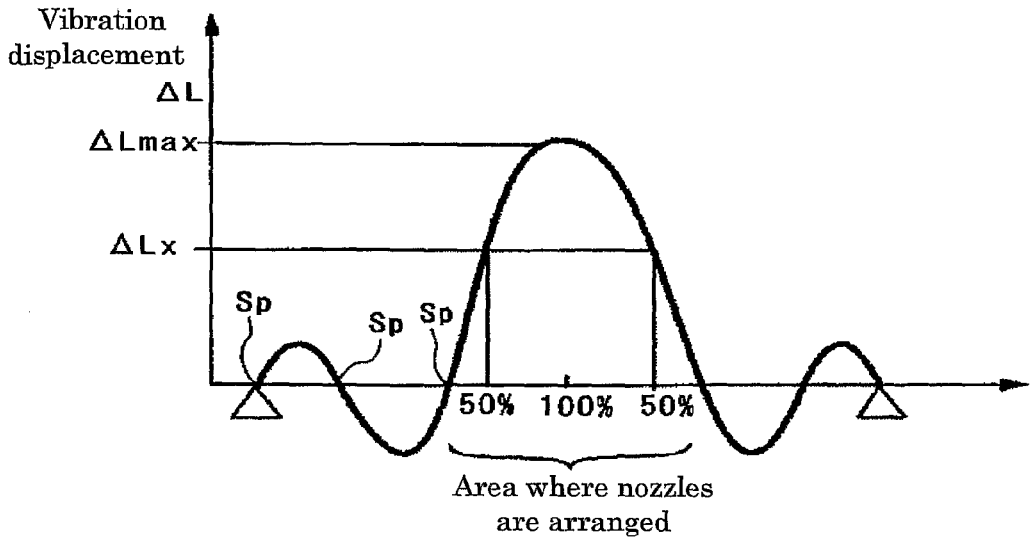
FIG. 24 is a graph of a displacement of the thin film vibrating in a multi-node mode vs. a position in the thin film.
Figure 25:
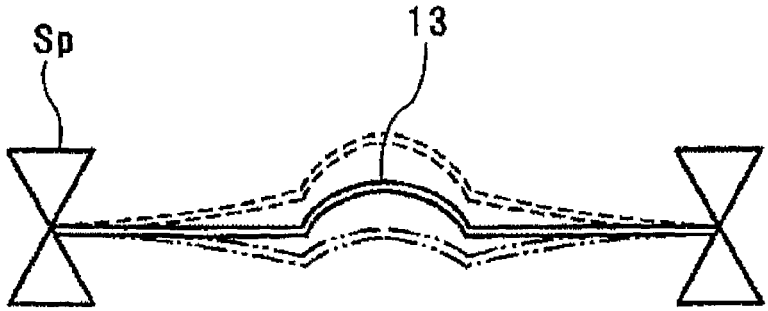
FIG. 25 schematically illustrates a thin film having a convex portion at its center portion.

In addition to the case where the thin film 13 is vibrated with respect to the circumference fulcrum, as shown in FIGS. 23 and 24, the thin film 13 may be vibrated upward or downward with respect to a plurality of fulcrums in a plane direction, which is not preferred. In this case, use of the thin film 13 having a convex portion at its center portion (shown in FIG. 25) could control the vibration amplitude and the movement direction of liquid droplets.

When the thin film 13 is vibrated, a sound pressure of Pac is generated in the carrier core composition liquid facing it. This sound pressure Pac is proportional to the vibration speed Vm of the thin film 13. This pressure Pac is known to arise as a result of reaction of the radiation impedance Zr of the medium (carrier core composition liquid), and is calculated based on the following equation.

$$Pa(r,t)=Zr*Vm(r,t)$$

The vibration speed Vm of the thin film 13 periodically varies with time (i.e., a function of time) and may form various periodic variations (e.g., a sine waveform and rectangular waveform). Also, as described above, the vibration displacement in a vibration direction varies depending on a position in the thin film 13; i.e., the vibration speed Vm is also a function of a position. Preferable vibration forms of the thin film are radially symmetric, as mentioned above. Thus, the vibration form is virtually a function of a radial coordinate.

The carrier core composition liquid is discharged to a gaseous phase by the action of a sound pressure periodically changing proportional to the position-dependent vibration speed of the thin film 13. Then, the carrier core composition liquid, which has been periodically discharged to the gaseous phase, becomes spherical attributed to the difference in surface tension between in the liquid phase and in the gaseous phase, periodically forming and discharging liquid droplets. As a result, the carrier core composition liquid is discharged from ejection holes 13*a* in a form of liquid droplet.

That is, the carrier particle production method of this embodiment uses the thin film 13 having a plurality of ejection holes 13*a*; the excitation section 21 serving as a vibration generating unit configured to generate vibration; the amplification section 25, serving as a vibration amplifying unit, which amplifies a vibration generated from the excitation section 21 and in which the vibration applying surface 25*a* for applying the vibration to the thin film 13 is provided so as to face the thin film 13; and the raw material tank 2 and the liquid accommodating section 11 which serve as a liquid feeding unit configured to feed the carrier core composition liquid to a space between the vibration applying surface 25*a* and the thin film 13. In this method, the vibration applying surface 25*a* transmits the vibration via the carrier core composition liquid to the flexible thin film 13 to repeatedly vibrate it in a thickness direction in a flexural manner, to thereby change the hydraulic pressure of the carrier core composition liquid present between the vibration applying surface 25*a* and the thin film 13. As a result, liquid droplets are periodically discharged from the ejection holes 13*a* (a step of periodically forming and discharging liquid droplets). Differing from a conventional configuration, in the above-described configuration, the carrier core composition liquid is discharged in a form of liquid droplet from the ejection holes 13*a* without pressure-feeding. With this configuration, in the liquid accommodating section 11, solid matter contained in the carrier core composition liquid can be prevented from localizing in the ejection holes 13*a*, unlike the case where the carrier core composition liquid is pressure-fed to the ejection holes 13*a*. Further, dispersibility of solid matter contained in the carrier core composition liquid is promoted by repeatedly vibrating the thin film 13. This is because a pressure is applied to the carrier core composition liquid contained in the liquid accommodating section 11 not only in a direction approaching the ejection holes 13*a* but also in a direction moving away from the ejection holes 13*a*. This production method, therefore, can stably form liquid droplets over a long period of time and produce small carriers with small variation in size.

According to the findings obtained by the present inventors from experiments, it is advantageous that a plurality of ejection holes 13*a* are formed in the thin film 13 so as to be arranged in an area around a position where a maximum displacement ΔLmax is observed, in which area a displacement ΔL is equal to or higher than 50% of the maximum displacement ΔLmax (i.e., ΔLmax/ΔLx=2.0 or lower). Specifically, the thin film 13 having the ejection holes 13*a* arranged in this manner can form liquid droplets with small variation in size, resulting in producing carrier core particles capable of attaining formation of a high-quality image. Notably, the displacement ΔL was measured with a scanning laser doppler vibrometer (PSV300, product of Polytec, Co.).

The frequency vibration of the thin film 13 is preferably 20 kHz to 2.0 MHz, more preferably 50 kHz to 500 kHz. When it is adjusted to 20 kHz or higher, dispersibility of microparticles contained in the carrier core composition liquid is promoted through excitation. When it is adjusted to 20 kHz, dispersed solid particles contained in the carrier core composition liquid are suitably vibrated and thus, can be stably discharged from the ejection holes 13*a* without adhering to the inner wall thereof. When it is adjusted to 2.0 MHz or lower, the thin film can be prevented from generating a multinode vibration.

The vibration frequency was determined by measuring the frequency of a vibrating unit with a scanning laser doppler vibrometer.

Also, when the sound pressure is 10 kPa or higher, dispersibility of microparticles is further promoted. Here, the larger the vibration displacement in an area of the thin film 13 which area has the ejection holes 13*a*, the larger the diameter of the liquid droplets formed. When the vibration displacement is small, the formed liquid droplets are small or no liquid droplets are formed. In order to reduce variation in size of the liquid droplets, the ejection holes 13*a* must be formed in optimal positions determined in consideration of the vibration displacement of the thin film 13.

As a result of experiments performed by changing the conditions for a carrier core composition liquid, it was found that a range of conditions where a viscosity is set to 20 mPa·s or less and a surface tension was set to 20 mN/m to 75 mN/m is similar to a range of conditions where satellite liquid droplets begin to take place. Thus, the sound pressure is preferably 10 kPa to 500 kPa, more preferably 100 kPa or lower. When a plurality of ejection holes 13*a* are formed in the thin film 13 so as to be arranged within an area where the sound pressure falls within the above range, generation of the satellite liquid droplets can be prevented. Also, when the sound pressure is adjusted to 10 kPa or higher, dispersibility of microparticles can be promoted. Note that a sound pressure was determined through numerical calculations based on correlation with a vibration amplitude.

Next will be roughly described a production method for carrier core particles using the carrier core particle production apparatus 1 having such a configuration. In FIG. 15, while feeding the carrier core composition liquid contained in the tank 2 to the liquid droplet jetting nozzle 10, a drive pulse signal (voltage) having a required frequency is applied to the vibration generating unit 20 of the liquid droplet jetting nozzle 10, to thereby vibrate the vibration applying surface 25*a* of the vibration generating unit 20. As a result, the thin film 13 is periodically vibrated to periodically discharge the carrier core composition liquid in a form of liquid droplet from ejection holes 13*a*. The thus-formed liquid droplets are released to the particle forming section 50. In this step, liquid droplets are short-periodically discharged from the ejection holes 13*a* of the liquid droplet jetting nozzle 10 (a step of periodically forming and discharging liquid droplets). As compared with a conventional apparatus, production efficiency was found to be remarkably improved since no clogging occurred in the ejection holes 13*a*. Also, this production method can stably form liquid droplets and produce small carriers with small variation in size.

The solvent of the liquid droplets released in the particle forming section 50 is removed with dry gas 51 flowing in a direction in which the liquid droplets flow, whereby carrier core particles are obtained. In this step, the liquid droplets formed in a step of periodically forming and discharging liquid droplets are solidified to form carrier core particles (a particle formation step). The dry gas used is not particularly limited, so long as it can dry liquid droplets. Examples thereof include gas having a dew point of −10° C. or lower in an atmospheric pressure (e.g., air and nitrogen gas).

The carrier core particles formed in the particle forming section 50 are collected by the particle collecting section 60 and then transferred via an unillustrated tube to a reservoir for the carrier core particles. The particle collecting section 60 has a tapered cross-sectional shape in which the pore size gradually decreases from the inlet (the side closer to the liquid droplet jetting nozzle 10) toward the outlet. In this configuration, the carrier core particles are transferred from the outlet of the particle collecting section 60 to the reservoir with the flowing dry gas 51. Alternatively, the formed carrier core particles may be pressure-fed from the particle collecting section 60 to the reservoir for carrier core particles, or the formed carrier core particles may be sucked from the reservoir for carrier core.

The dry gas 51 preferably flows in a form of vortex stream, since the formed carrier core particles are assuredly transferred using a centrifugal force generated. Alternatively, liquid droplets may be dried in a single cooling section to form carrier core particles.

Figure 26:
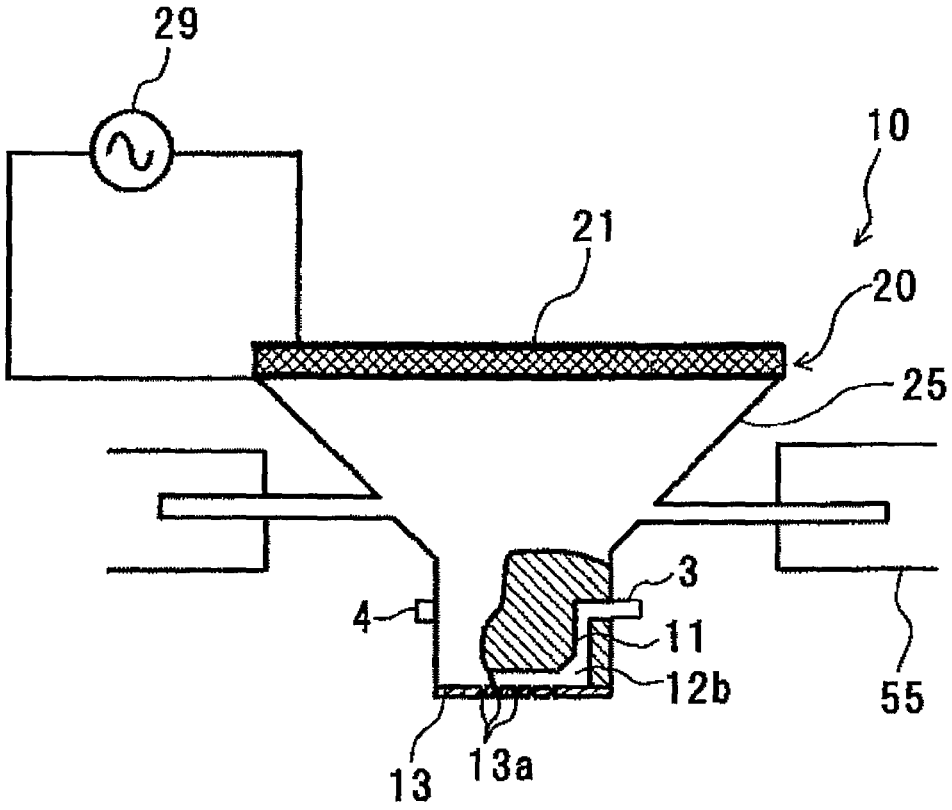
FIG. 26 is an enlarged view of a liquid droplet jetting nozzle of a first modification embodiment.

FIG. 26 is an enlarged view of a first modification embodiment of the liquid droplet jetting nozzle 10. In this embodiment, a vibration generating unit 20 of the liquid droplet jetting nozzle 10 is a horn vibrator having an excitation section 21 formed of a piezoelectric element, and a horn amplification section 25. In this vibration generating unit 20, a thin film 13 is fixed on a vibration applying surface of the amplification section 25 and a liquid accommodating section 11 for accommodating a carrier core composition liquid is provided in the horn amplification section 25. The vibration generating unit 20 is fixed via a flange-shaped fixing section 55 on the wall of a particle forming section 50. Alternatively, this may be fixed with an unillustrated elastic member for the purpose of avoiding damping of a vibration transmitted.

Figure 27:
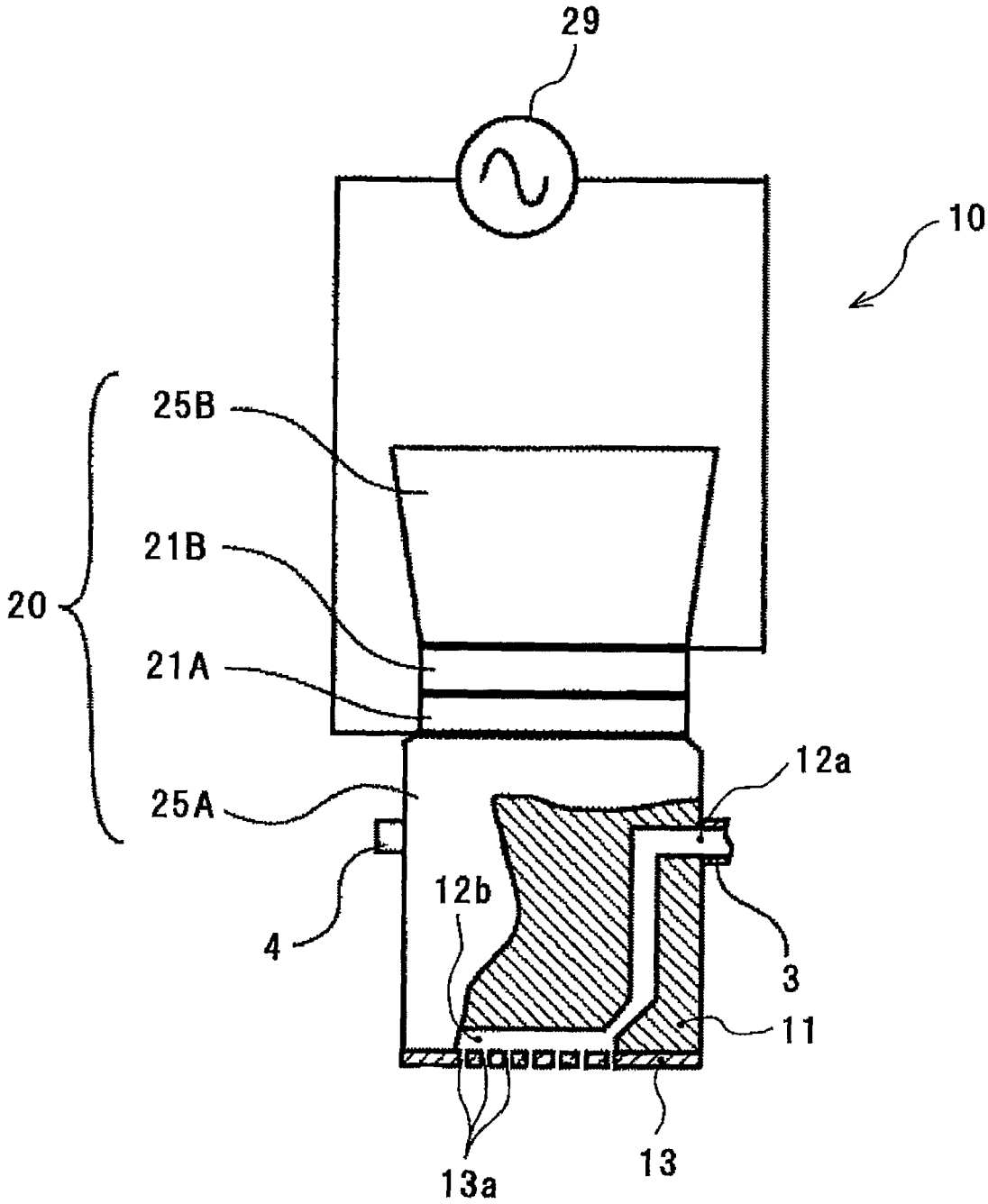
FIG. 27 is an enlarged view of a liquid droplet jetting nozzle of a second modification embodiment.

FIG. 27 is an enlarged view of a second modification embodiment of the liquid droplet jetting nozzle 10. In this embodiment, a vibration generating unit 20 of the liquid droplet jetting nozzle 10 has a pair of excitation sections and a pair of vibration sections. Specifically, a first excitation section 21B formed of a piezoelectric element is laminated on a second excitation section 21A formed of a piezoelectric element. A first horn amplification section 25B and a second horn amplification section 25A are fixed on the first excitation section 21B and the second excitation section 21A, respectively. Such a vibration generating unit 20 is commercially available as a bolting Langevin transducer. The liquid accommodating section 11 is provided in the second amplification section 25A, and a thin film 13 is fixed on a vibration applying surface of the second amplification section 25A.

The above-described production apparatus has one liquid droplet jetting nozzle 10. Alternatively, a plurality of liquid droplet jetting nozzles 10 may be fixed in a row on one particle forming section 50. In this case, the carrier core composition liquid is fed via an individual pipe to the liquid accommodating section 11 of each of the liquid droplet jetting nozzles 10 from a common raw material tank 2. The carrier core composition liquid may be self-supplied in accordance with forming liquid droplets. Alternatively, during operation of the carrier production apparatus, the pump may be subsidiarily used for liquid supply.

Figure 28:
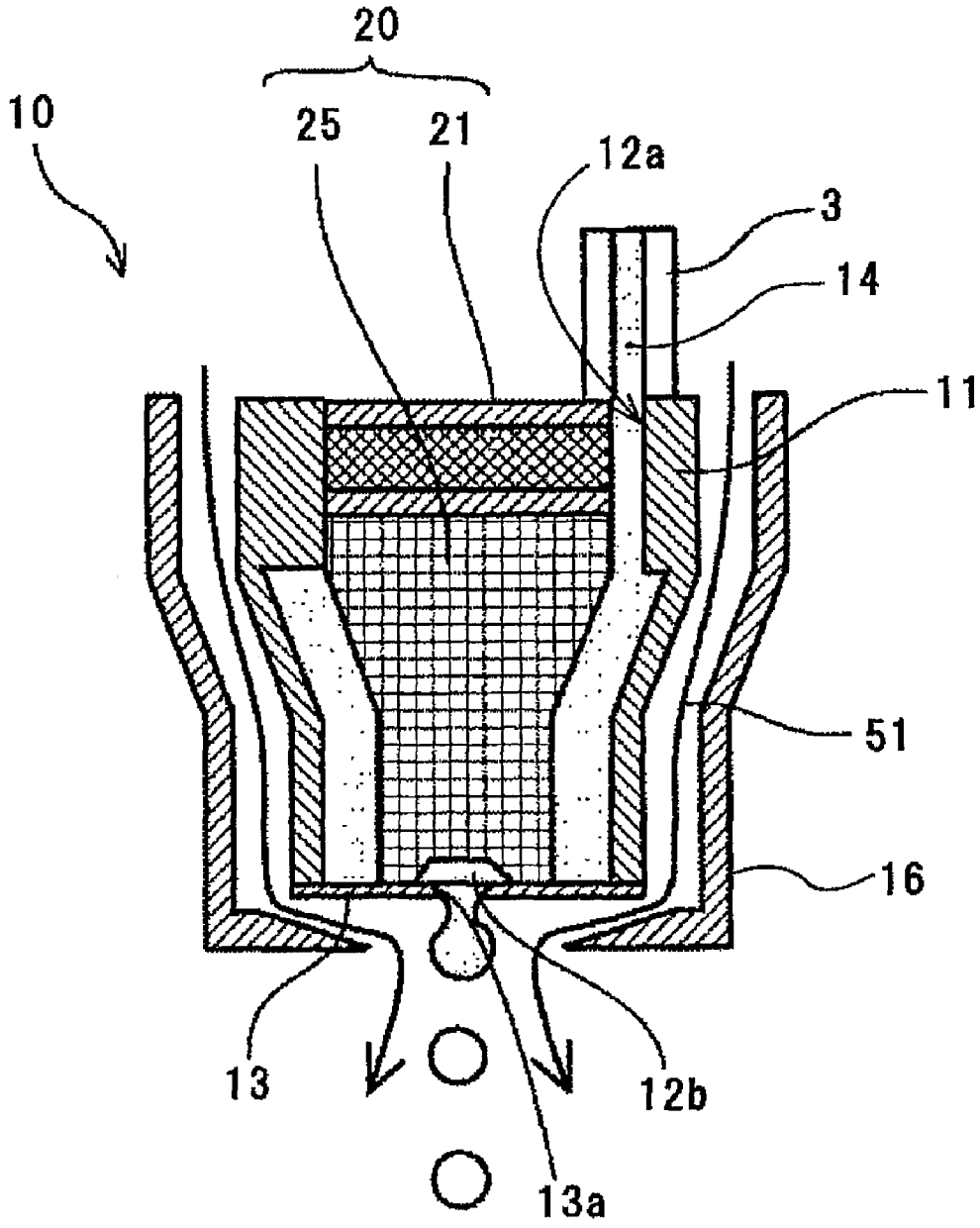
FIG. 28 is an enlarged view of a liquid droplet jetting nozzle of a third modification embodiment.

FIG. 28 is an enlarged view of a third embodiment of the liquid droplet jetting nozzle 10. In FIG. 28, one ejection hole 13*a* is illustrated for the sake of convenience, but actually a plurality of ejection holes 13*a* are formed. This liquid droplet jetting nozzle 10 includes a vibration generating unit 20 having a horn amplification section 25; a liquid accommodating section 11 which is provided so as to surround the vibration generating unit 20 and which forms an accommodating space 12*b*, and a receiving flow passage 12*a* for feeding a raw material liquid 14; and a thin film 13. The liquid accommodating section 11 is covered with a cover member 16. A gas flow passage is formed between the cover member 16 and the outer wall of the liquid accommodating section 11. The liquid droplets discharged from the ejection hole 13*a* flow together with dry gas 51 flowing through the gas flow passage to be released from the inlet of the cover member 16.

Figure 29:
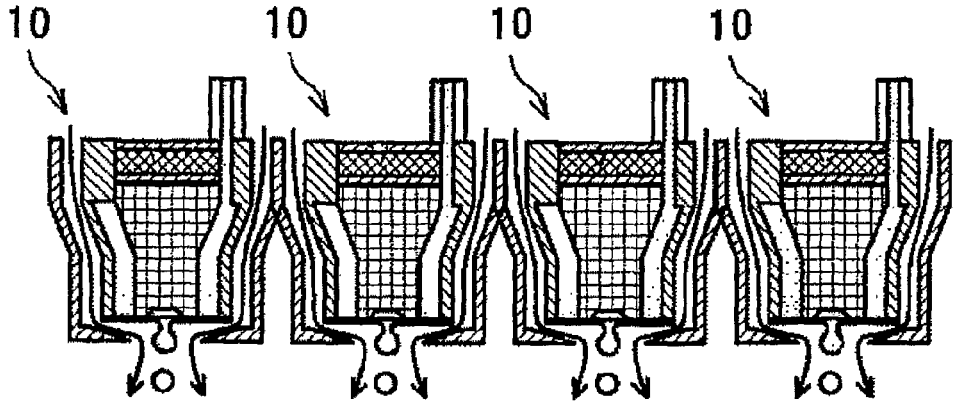
FIG. 29 is an enlarged view of liquid droplet jetting nozzles provided in a row.

As shown in FIG. 29, a plurality of the liquid droplet jetting nozzles 10 having such a configuration (e.g., 100 to 1,000 liquid droplet jetting units in terms of controllability) are preferably fixed in a row on the particle forming section 50. With this configuration, production efficiency can be improved.

The carrier core particles produced by the carrier production method of the first or second embodiment are provided thereon with a resin layer to form carrier particles as a final product. The method for forming the resin layer may be any of conventionally known methods such as spray drying, dip coating and powder coating.

(Carrier)

Next will be described a carrier for electrophotographic developer of the present invention. The carrier for electrophotographic developer of the present invention is produced with the production method for carrier core particles using the above-described carrier production apparatus, and has a monodisperse particle distribution. The carrier for electrophotographic developer (hereinafter referred to simply as a "carrier") in this embodiment includes a magnetic core particle produced using the above-described production apparatus and a resin layer formed on the surface thereof.

The carrier of this embodiment has a weight average particle diameter D4 of 15 μm to 35 μm. When the weight average particle diameter D4 is greater than 35 μm, carrier adhesion is not easily caused. But, when toner is used in a large amount for forming an image with high density, background smear is significantly observed. Also, when a latent image has small dots, variation in diameter of the dot becomes large. Whereas when the particle size of the carrier is adjusted to be small for forming high-resolution image, carrier adhesion considerably occurs. The present inventors have newly found that relatively small particles (18 μm or smaller) mainly caused carrier adhesion. Here, "carrier adhesion" refers to a phenomenon in which carriers adhere to an image portion or a background portion of the latent electrostatic image. This phenomenon is likely to occur with increasing of the intensity of electrical field, and is more frequently observed in the background portion than in the image portion which is developed with toner to be decreased in the intensity of electrical field. Such carrier adhesion may cause scratches on a photoconductor drum and/or fixing roller, which is not preferred.

The particle size distribution was measured using a Microtrack particle size analyzer (model HRA9320-X100, product of Honewell Co.) under the following conditions:

(1) Range of particle diameter: 100 nm to 8 μm (2) Channel length (channel width): 2 μm (3) Number of channels: 46

(4) Refractive index: 2.42

The carrier core particles of this embodiment preferably have a ratio of the D4 to the number average particle diameter (Dn):(D4/Dn) of 1.00 to 1.50, more preferably 1.00 to 1.10, and have a sharp particle size distribution. Thus, although the carrier of this embodiment has a small weight average particle diameter; i.e., 20 μm to 35 μm, carrier adhesion is not caused. This carrier can provide an image which is excellent in dot- and highlight-reproducibility, which is high in image density, and which has less background smear.

The carrier of this embodiment has a resistivity Log R (Ω·cm) of 12.0 or higher, more preferably 13.0 or higher. When the resistivity is lower than 12.0, for example, the developing gap (the closest distance between a photoconductor and a developing sleeve) must be small. In this state, increase in electric field makes the carrier to be charged, resulting in that carrier adhesion is highly likely to occur. This phenomenon is considerably observed in accordance with increasing of the linear velocities of the photoconductor and the developing sleeve.

Further, carrier adhesion is often observed in the carrier which has an extremely ununiform coat layer and/or whose cores are partially exposed. Also, the resin coat of the carrier is gradually abraded or peeled off after long-term use, causing carrier adhesion. This is also caused as a result that the carrier is charged.

The present inventors attempt to avoid this unfavorable phenomenon and have found that when the coat layer in the vicinity of the carrier core surface is larger in resistivity than that in the vicinity of the carrier surface, carrier adhesion, which is caused by the carrier having a small particle diameter, does not easily occur even after long-term use; i.e., carrier adhesion can be effectively prevented. Specific means include a method in which a high-resistivity-layer is provided on the carrier core surface, and a method in which a coat layer is formed so that the resistivity thereof is gradually increased toward the carrier core. In the latter method, a plurality of coat layers having different resistivities can formed on the carrier core surface, or a coating liquid used can be gradually decreased in resistivity in accordance with the time spent in formation of a coat layer.

The resistivity of the carrier can be controlled by adjusting the resistivity and thickness of the resin coated on the core particles. Also, it can be controlled by incorporating conductive fine powder into the coat layer. Examples of the conductive fine powder include powder of metals (e.g., conductive ZnO and Al) and oxides thereof; $SnO_2$ prepared with various methods or doped with various elements; borides (e.g., $TiB_2$, $ZnB_2$ and $MoB_2$); silicon carbide; conductive polymers (e.g., polyacetylene, polyparaphenylene, poly(paraphenylene sulfide)polypyrrole and polyethylene); and carbon black (e.g., furnace black, acetylene black and channel black).

The conductive fine powder is added to a solvent used for forming a coating liquid or into a resin solution for coating, and then is uniformly dispersed with a disperser using media (e.g., a ball mill and bead mill) or a stirrer equipped with a high-speed rotating blade.

The resistivity of the carrier is measured as follows. Specifically, carriers are charged into a fluorine-resin cell having 2 cm×4 cm electrodes which are disposed 2 mm apart; a DC voltage of 100V is applied between the electrodes; the DC resistivity is measured with a high resistance meter 4329A (4329A+LJK 5HVLVWDQFH OHWHU, product of Yokokawa-HEWLETT-PACKARD); and the electrical resistivity Log R (Ω·cm) is calculated from the obtained value.

In parallel with this, when the magnetic moment was adjusted to 76 emu/g or higher at 1 KOe, carrier adhesion was drastically reduced.

In this embodiment, the carrier preferably has a bulk density of 2.15 g/cm$^3$ to 2.70 g/cm$^3$, more preferably 2.20 g/cm$^3$ to 2.70 g/cm$^3$. When the bulk density is less than 2.15 g/cm$^3$, the formed carrier has too high porosity or considerable irregularities on its surface, making it difficult for the additive used to sufficiently exhibit its effects. In the case where the bulk density is low, even when the magnetization (emu/g) is high at 1 KOe, substantial magnetization per one particle is low, undesirably increasing the chance of carrier adhesion.

Also, the carrier core particles preferably have a magnetization of 40 emu/g to 150 emu/g, more preferably about 130 emu/g, when a magnetic field of 1,000 Oersted is applied thereto. When the magnetization falls within the above range, adhesion of additives to the carrier surface is not observed through scanning electron microscopy. Whereas when the magnetization is high, additives adhere to the carrier surface, resulting in changing the carrier in fluidity.

Also, the present inventors carried out studies using carrier samples having varied magnetizations in relation to the magnetic constraining force and have found that carrier adhesion was reduced in the carrier having a magnetic moment of 40 emu/g or higher, more preferably 50 emu/g or higher, when a magnetic field of 1,000 Oersted (Oe) is applied thereto. When the magnetization is lower than 40 emu/g, carrier adhesion easily occurs, which is not preferred. Whereas when the magnetization is higher than 150 emu/g, a stiff magnetic brush is undesirably formed to impair uniform development in fine portions. Notably, the magnetization can be measured with a B-H tracer (BHU-60, product of Riken Denshi Co.) as follows. Specifically, carrier core particles (1.0 g) are charged into a cylindrical cell and the cell is set to the tracer. In this tracer, the first magnetic field is gradually increased to 3,000 Oersted and then gradually decreased to 0 Oersted. Next, the second magnetic field, which is an opposite direction to the first magnetic field, is gradually increased to 3,000 Oersted and then gradually decreased to 0 Oersted. In this state, the first magnetic field is applied again to give a B-H curve. The magnetization at 1,000 Oersted is calculated based on the thus-obtained B-H curve.

In this embodiment, the core particles of the carrier can be made of any of conventionally known magnetic materials. Examples of magnetic materials having a magnetic moment of 40 emu/g or higher when a magnetic field of 1,000 Oersted is applied thereto include ferromagnetic materials (e.g., iron and cobalt), magnetites, hematites, Li ferrites, Mn—Zn ferrites, Cu—Zn ferrites, Ni—Zn ferrites, Ba ferrites and Mn ferrites. Notably, in general, the ferrite is a sintered product represented by the chemical formula $(MO)x(NO)y(Fe_2O_3)z$ (where x+y+z=100 mol % and each of M and N represents a metal atom selected from Ni, Cu, Zn, Li, Mg, Mn, Sr and Ca), the sintered product being formed of a complete mixture of a divalent metal oxide and a trivalent iron oxide. Preferred examples thereof include iron-containing materials, Mn—Mg—Sr ferrites, Mn ferrites and magnetites.

The carrier of this embodiment can be produced as follows: raw materials used for forming carrier core particles are mixed with one another to prepare a slurry; the resultant slurry is atomized to produce primarily granulated products, followed by firing and crushing, to thereby produce carrier core particles; and the carrier core particles are coated with resin for forming a resin coat layer.

The resin layer of the carrier of this embodiment is formed of any of conventionally known resins. Preferred are silicone resins having, as a repeating unit, moieties A, B and C each having the following structural formulas; or having, as a repeating unit, a moiety formed by appropriately combining moieties A and B, (A)

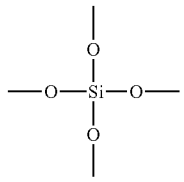

(B)

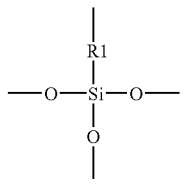

(C)

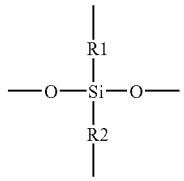

In structural formulas B and C, R1 represents a hydrogen atom, halogen atom, hydroxyl group, methoxy group, lower alkyl group having 1 to 4 carbon atoms or aryl group (e.g., phenyl group and tolyl group); and R2 represents alkylene group having 1 to 4 carbon atoms or arylene group (phenylene group). The aryl group preferably has 6 to 20 carbon atoms, more preferably 6 to 14 carbon atoms, and examples thereof include benzene-derived aryl groups (e.g., phenyl group), condensed polycyclic aromatic hydrocarbon (e.g., naphthalene, phenanthrene, and anthracene)-derived aryl groups and chain polycyclic aromatic hydrocarbon (e.g., biphenyl and terphenyl)-derived aryl groups. The aryl group may have various substituents.

The arylene group preferably has 6 to 20 carbon atoms, more preferably 6 to 14 carbon atoms, and examples thereof include benzene-derived arylene groups (phenylene group), condensed polycyclic aromatic hydrocarbon (e.g., naphthalene, phenanthrene, and anthracene)-derived arylene groups and chain polycyclic aromatic hydrocarbon (e.g., biphenyl and terphenyl)-derived arylene groups. The arylene group may have various substituents.

Examples of the silicone resin used in the carrier of the this embodiment include straight silicone resins such as KR271, KR272, KR282, KR252, KR255, KR152 (these products are of Shin-Etsu Chemical Co., Ltd.), SR2400 and SR2406 (these products are DOW CORNING TORAY SILICONE CO., LTD.).

Alternatively, a modified silicone resin may be used in the carrier of this embodiment. Examples of the silicone resin include epoxy-modified silicone resins, acrylic-modified silicone resins, phenol-modified silicone resins, urethane-modified silicone resins, polyester-modified silicone resins and alkyd-modified silicone resins. Specific examples thereof include ES-1001N (epoxy modified product), KR-5208 (acrylic-modified product), KR-5203 (polyester-modified product), KR-206 (alkyd-modified product), KR-305 (urethane-modified product) (these products are of Shin-Etsu Chemical Co., Ltd.), SR2115 (epoxy modified product) and SR2110 (alkyd-modified product) (these products are of DOW CORNING TORAY SILICONE CO., LTD.).

Also, the below-listed materials may be used alone or in combination with the above-listed silicone resin; i.e., polystyrenes, polychlorostyrenes, poly(α-methylstyrenes), styrene-chlorostyrene copolymers, styrene-propylene copolymers, styrene-butadiene copolymers, styrene-vinylchloride copolymers, styrene-vinylacetate copolymers, styrene-maleic acid copolymers, styrene-acrylic acid ester copolymers (e.g., styrene-methyl acrylate copolymers, styrene-ethyl acrylate copolymers, styrene-butyl acrylate copolymers, styrene-octyl acrylate copolymers and styrene-phenyl acrylate copolymers), styrene-methacrylic acid ester copolymers (e.g., styrene-methyl methacrylate copolymers, styrene-ethyl methacrylate copolymers, styrene-butyl methacrylate copolymers and styrene-phenyl methacrylate copolymers), styrene resins (e.g., styrene-α-chloromethyl acrylate copolymers and styrene-acrylonitrile-acrylic acid ester copolymers), epoxy resins, polyester resins, polyethylene resins, polypropylene resins, ionomer resins, polyurethane resins, ketone resins, ethylene-ethyl acrylate copolymers, xylene resins, polyamide resins, phenol resins, polycarbonate resins, melamine resins and fluorine resins.

The method for forming a resin layer on the surface of carrier core particles may be any of conventionally known methods (e.g., spray drying, dip coating and powder coating). Of these, a method using a fluidized bed coater is suitably used for forming a uniform coat layer. The thickness of the resin layer on the carrier is generally 0.02 μm to 1 μm, more preferably 0.03 μm to 0.8 μm.

Also, when an amino silane coupling agent is incorporated into the resin layer formed from the above-listed silicone resin, a highly durable carrier can be obtained. Examples of the amino silane coupling agent used include the below-listed compounds. The amount of the amino silane coupling agent contained in the resin layer is preferably 0.001% by mass to 30% by mass.

$H_2N(CH_2)_3Si(OCH_3)_3$ (MW: 179.3)
$H_2N(CH_2)_3Si(OC_2H_5)_3$ (MW: 221.4)
$H_2NCH_2CH_2CH_2Si(CH_3)_2(OC_2H_5)$ (MW: 161.3)
$H_2NCH_2CH_2CH_2Si(CH_3)(OC_2H_5)_2$ (MW: 191.3)
$H_2NCH_2CH_2NHCH_2Si(OCH_3)_3$ (MW: 194.3)
$H_2NCH_2CH_2NHCH_2CH_2CH_2Si(CH_3)(OCH_3)_2$ (MW: 206.4)
$H_2NCH_2CH_2NHCH_2CH_2CH_2Si(OCH_3)_3$ (MW: 224.4)
$(CH_3)_2NCH_2CH_2CH_2Si(CH_3)(OC_2H_5)_2$ (MW: 219.4)
$(C_4H_9)_2NC_3H_6Si(OCH_3)_3$ (MW: 291.6)

The resistivity of the carrier can be controlled by adjusting the resistivity and thickness of the resin coated on the core particles. Also, it can be controlled by incorporating conductive fine powder into the resin coat layer. Examples of the conductive fine powder include powder of metals (e.g., conductive ZnO and Al) and oxides thereof; $SnO_2$ prepared with various methods or doped with various elements; borides (e.g., $TiB_2$, $ZnB_2$ and $MoB_2$); silicon carbide; conductive polymers (e.g., polyacetylene, polyparaphenylene, poly(paraphenylene sulfide)polypyrrole and polyethylene); and carbon black (e.g., furnace black, acetylene black and channel black).

The conductive fine powder is added to a solvent used for forming a coating liquid or into a resin solution for coating, and then is uniformly dispersed with a disperser using media (e.g., a ball mill and bead mill) or a stirrer equipped with a high-speed rotating blade.

(Developer)

A developer of the present invention is formed of a toner and the above-described carrier of the present invention.

From the finding obtained by the present inventors, when the charging amount of the toner covering the carrier at a coverage of 50% is adjusted to 15 μc/g to 50 μc/g, the formed electrophotographic developer attains reduced background smear and carrier adhesion. The coverage of the carrier with the toner is calculated using an equation given below.

$$\text{Coverage}\ (\%)=(Wt/Wc)\times(\rho c/\rho t)\times(Dc/Dt)\times(1/4)\times 100$$

In the above equation, Dc denotes a weight average particle diameter (μm) of the carrier, Dt denotes a weight average particle diameter (μm) of the toner, Wt denotes a mass (g) of the toner, We denotes a mass (g) of the carrier, pt denotes a true density ($g/cm^3$) of the toner and ρc denotes a true density ($g/cm^3$) of the carrier.

From the finding obtained by the present inventors, use of a developer containing the carrier of the above embodiment and a toner having a weight average particle diameter of 3.0 μm to 6.0 μm can provide a high-quality image excellent in, among others, granularity. Note that the weight average particle diameter of the toner was measured with a Coulter counter (product of Coulter Counter, Co.).

<Toner>

The toner used in the developer of this embodiment includes a binder resin mainly containing a thermoplastic resin, a colorant and microparticles and, if necessary, includes other components such as a charge controlling agent and a releasing agent.

The production method for the toner is not particularly limited and can be appropriately selected depending on the purpose. Examples of the production method which can be employed include the pulverization method; the emulsion polymerization method in which an oil phase is emulsified in an aqueous medium to form toner base particles; the suspension polymerization/polymer suspension method in which an oil phase is dispersed/aggregated in an aqueous medium to form toner base particles; polymerization methods in which a monomer composition containing a specific crystalline polymer and a polymerizable monomer is polymerized directly in an aqueous phase (suspension/emulsion polymerization); a polyaddition method in which a composition containing a specific crystalline polymer and an isocyanate group-containing prepolymer is subjected to elongation/crosslinking reaction using an amine directly in an aqueous phase; a polyaddition method using an isocyanate group-containing prepolymer; a method including dissolving raw materials in a solvent, removing the solvent and pulverizing; and the melt-spray method.

In the pulverization method, for example, toner materials are molten/kneaded, pulverized and classified to form toner base particles. In this method, the shape of the toner base particles may be controlled through application of mechanical impact for the purpose of increasing the average circularity of the toner. Such mechanical impact may be applied to the toner base particles with a hybridizer, a mechanofusion and other devices. For forming the toner, a mixture of toner materials is charged into a melt-kneader for melt-kneading. Examples of the melt-kneader include uniaxial continuous kneaders, biaxial continuous kneaders and batch kneaders using a roll mill. Preferred examples thereof include a KTK-type biaxial extruder (product of KOBE STEEL. Ltd.), a TEM-type extruder (product of TOSHIBA MACHINE CO., LTD.), a biaxial extruder (product of KCK Co., Ltd.), a PCM-type biaxial extruder (product of IKEGAI LTD.) and a co-kneader (product of BUSS Company). Preferably, the melt-kneading is performed under appropriate conditions so as not to cleave the molecular chains of the binder resin. The temperature during melt-kneading is determined in consideration of the softening point of the binder resin. Specifically, when the temperature is too higher than the softening point, cleavage of the molecular chains occurs to a considerable extent; whereas when the temperature is too lower than the softening point, a sufficient dispersion state is difficult to attain. The thus-kneaded product is pulverized to form particles. In this pulverization, the kneaded product is roughly pulverized and then finely pulverized. Preferred examples of pulverizing methods include a method in which the kneaded product is crushed against a collision plate under a jet stream for pulverization, a method in which the kneaded particles are crushed one another under a jet stream for pulverization, and a method in which the kneaded product is pulverized by passage through the narrow gap between a mechanically rotating rotor and a stator. Then, the thus-pulverized products can be classified to form particles having a predetermined particle diameter by removing microparticles with a cyclone, a decanter, a centrifugal separator, etc.

In the suspension polymerization method, a colorant, a releasing agent, etc., are dispersed in a mixture of an oil-soluble polymerization initiator and a polymerizable monomer, and the resultant dispersion is emulsified/dispersed with the below-described emulsification method in an aqueous medium containing, for example, a surfactant and a solid dispersant. The thus-obtained mixture was subjected to polymerization reaction to form toner particles and then inorganic microparticles are made to adhere to the surface of the formed toner particles through a wet process in the present invention. This wet process is preferably performed after removal of an excessive surfactant, etc. through washing. Also, a functional group can be introduced to the surface of the toner particles using, as an additional polymerizable monomer, an acid compound (e.g., acrylic acid, methacrylic acid, α-cyanoacrylic acid, α-cyanomethacrylic, itaconic acid, crotonic acid, fumaric acid, maleic acid or maleic anhydride); acrylamide, methacrylamide, diacetoneacrylamide, a methylol compound thereof, vinylpyridine, vinylpyrrolidone, vinylimidazole, ethyleneimine or an amino group-containing (meth) acrylate (e.g., dimethylaminoethyl methacrylate)). Further, a dispersant having an acid or basic group may be adsorbed on the surface of the particles for introducing a functional group.

In the emulsion polymerization method, a water-soluble polymerization initiator and polymerizable monomer are emulsified in water with a surfactant. The thus-obtained emulsion is treated through a commonly used emulsion polymerization process to form a latex. Separately, a colorant, a releasing agent, etc. are dispersed in an aqueous medium to prepare a dispersion, and the above-formed latex and the thus-prepared dispersion are mixed with each other. The toner components of the thus-obtained mixture are aggregated so as to have a size as toner particles, followed by fusing, to thereby form a toner. Thereafter, the below-described wet process is performed using inorganic microparticles. When the same monomers as used in the suspension polymerization method are used for forming a latex, a functional group can be introduced to the surface of the toner particles. These monomers can be used in combination with a wide variety of resins and exhibits excellent granulation performance. In addition, the formed toner from them exhibits an excellent low-temperature fixing property. Furthermore, use of them enable a toner to be easily controlled in particle diameter, particle size distribution and shape. In this method, a compound having an active hydrogen-containing group and toner materials containing a polymer capable of reacting therewith are dissolved/dispersed in an organic solvent, to thereby prepare a toner solution. Subsequently, the thus-prepared toner solution is emulsified/dispersed in an aqueous medium to prepare a dispersion. In this aqueous medium, the compound having an active hydrogen-containing group is reacted with the polymer capable of reacting therewith to produce adhesive base particles, followed by removal of the organic solvent, to thereby form a toner.

Examples of the binder resin contained in the toner include styrene binder resins such as substituted or unsubstituted styrene homopolymers (e.g., polystyrenes and polyvinyltoluenes); styrene copolymers (e.g., styrene-p-chlorostyrene copolymers, styrene-propylene copolymers, styrene-vinyltoluene copolymers, styrene-methyl acrylate copolymers, styrene-ethyl acrylate copolymers, styrene-butyl acrylate copolymers, styrene-methyl methacrylate copolymers, styrene-ethyl methacrylate copolymers, styrene-butyl methacrylate copolymers, styrene-methyl α-chloro methacrylate copolymers, styrene-acrylonitrile copolymers, styrene-vinyl methyl ether copolymers, styrene-vinyl methyl ketone copolymers, styrene-butadiene copolymers, styrene-isoprene copolymers, styrene-maleic acid copolymers, styrene-maleic acid ester copolymers); acrylic binder resins (e.g., polymethyl methacrylates and polybutyl methacrylates); polyvinyl chlorides; polyvinyl acetates; polyethylenes; polypropylenes, polyesters; polyurethanes; epoxy resins; polyvinyl butyrals; polyacrylic acid resins; rosin; modified rosins; terpene resins; phenol resins; aliphatic or alicyclic hydrocarbon resins; aromatic petroleum resins; chlorinated paraffins; and paraffin waxes. These may be used alone or in combination.

Rather than the styrene or acrylic resins, the polyester resins assure the storage stability of the toner and also, enable the fused toner to decrease in viscosity. Such a polyester resin can be produced by, for example, polycondensing an alcohol with a carboxylic acid. Examples of the alcohol include diols (e.g., polyethylene glycol, diethylene glycol, triethylene glycol, 1,2-propylene glycol, 1,3-propylene glycol, 1,4-propylene glycol, neopentyl glycol and 1,4-butendiol); 1,4-bis(hydroxymethyl)cyclohexane, bisphenol A, hydrogenated bisphenol A and etherified bisphenols (e.g., polyoxy-ethylenated bisphenol A and polyoxy-propylenated bisphenol A); the above divalent alcohol monomers having, as a substituent, a saturated or unsaturated hydrocarbon group having 3 to 22 carbon atoms; other divalent alcohol monomers; and tri- or more-valent alcohol monomers (e.g., sorbitol, 1,2,3,6-hexanetetrol, 1,4-sorbitan, pentaerythritol, dipentaerythritol, tripentaerythritol, sucrose, 1,2,4-butanetriol, 1,2,5-pentanetriol, glycerol, 2-methylpropanetriol, 2-methyl-1,2,4-butanetriol, trimethylol ethane, trimethylol propane and 1,3,5-trihydroxymethyl benzene). Examples of the carboxylic acid include monocarboxylic acids (e.g., palmitic acid, stearic acid and oleic acid); dicarboxylic acid monomers (e.g., maleic acid, fumaric acid, mesaconic acid, citraconic acid, terephthalic acid, cyclohexane dicarboxylic acid, succinic acid, adipic acid, sebacic acid and malonic acid); the above divalent organic acid monomers having, as a substituent, a saturated or unsaturated hydrocarbon group having 3 to 22 carbon atoms; anhydrides thereof; dimers formed of a lower alkyl ester and a linolenic acid; and tri- or more-valent carboxylic acid monomers (e.g., 1,2,4-benzene tricarboxylic acid, 1,2,5-benzene tricarboxylic acid, 2,5,7-naphthalene tricarboxylic acid, 1,2,4-naphthalene tricarboxylic acid, 1,2,4-butane tricarboxylic acid, 1,2,5-hexane tricarboxylic acid, 1,3-dicarboxyl-2-methyl-2-methylenecarboxypropane, tetra (methylencarboxyl)methane, 1,2,7,8-octanetetracarboxylic enball trimer acid and anhydrides thereof).

Examples of the epoxy resin include a polycondensate formed between bisphenol A and epichlorohydrin. Specific examples include commercially available products such as Epomic R362, R364, R365, R366, R367 and R369 (these products are of MITSUI OIL CO., LTD.); Epotote YD-011, YD-012, YD-014, YD-904 and YD-017 (these products are of Tohto Kasei Co., Ltd.); and Epocoat 1002, 1004 and 1007 (these products are of Shell Chemicals Japan Ltd.).

Examples of the colorant used in the toner in this embodiment include any conventionally known dyes and pigments such as carbon black, ramp black, iron black, ultramarine blue, nigrosine dyes, aniline blue, phthalocyanine blue, hansa yellow G, rhodamine 6G lake, calco oil blue, chrome yellow, quinacridone, benzidine yellow, rose Bengal, triarylmethane dyes and monoazo/disazo dyes/pigments. These colorants may be used alone or in combination.

The toner may be magnetic through addition of a magnetic material. The magnetic material which can be used may be fine powder of, for example, ferromagnetic materials (e.g., iron and cobalt), magnetites, hematites, Li ferrites, Mn—Zn ferrites, Cu—Zn ferrites, Ni—Zn ferrites and Ba ferrites.

The charge controlling agent is appropriately used for desirably controlling the frictional chargeability of the toner. Examples thereof include metal complex salts of monoazo dyes; nitrohumic acid and salts thereof; salicylic acid; naphthoic salts; metallic amino complexes formed between dicarboxylic acids and Co, Cr or Fe; quaternary ammonium compounds; and organic dyes.

As described above, a releasing agent may be incorporated into the toner used in the present invention, and examples thereof include any known releasing agents. Specific examples include, but not limited to, low-molecular-weight polypropylenes, low-molecular-weight polyethylenes, carnauba wax, microcrystalline wax, jojoba wax, rice wax and montanic acid wax. These may be used alone or in combination.

The toner may contain various additives. Imparting of sufficient fluidity to the toner is important for forming a high-quality image. Examples of commonly used fluidity improvers include hydrophobized metal oxide microparticles, lubricants, organic resin microparticles and metal soaps. Specific examples include fluorine resins (e.g., polytetrafluoroethylene), lubricants (e.g., zinc stearate), polishing agents (e.g., cerium oxide and silicon carbide), fluidity-imparting agent such as surface-hydrophobized inorganic oxides (e.g., $SiO_2$ and $TiO_2$), and known caking inhibitors and surface-treated products thereof. In particular, hydrophobic silica is preferably used for improving the fluidity of the toner.

(Image Forming Method)

An image forming method of the present invention includes at least a charging step of charging the surface of an image bearing member, an exposing step of exposing the image bearing member surface to light to thereby form a latent electrostatic image, a developing step of developing the latent electrostatic image with a developer to thereby form a visible image, a transferring step of transferring the visible image onto an recording medium, and a fixing the transferred image on the recording medium; and includes, if necessary, other steps.

This image forming method uses the developer of the present invention as described above.

(Process Cartridge)

A process cartridge used in the present invention includes an image bearing member, a charging unit configured to charge the surface of an image bearing member, a developing unit configured to develop an electrostatic image formed on the image bearing member surface with a developer of the present invention to thereby form a visible image, a cleaning unit configured to remove the developer remaining on the image bearing member surface; and includes, if necessary, other units.

Figure 30:
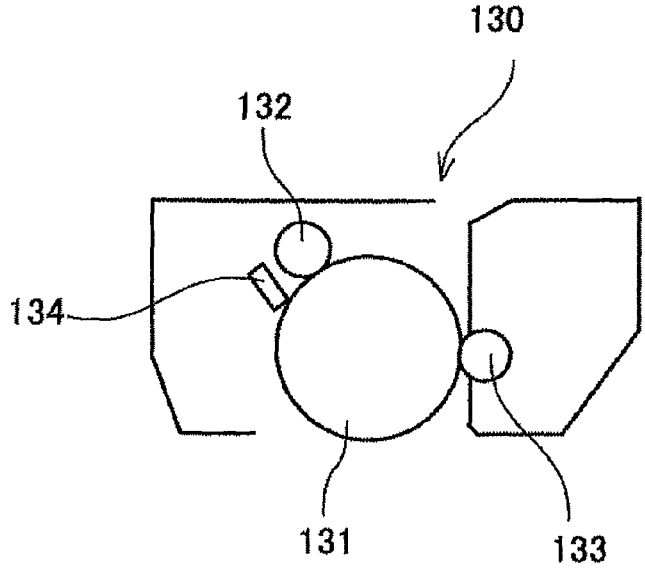
FIG. 30 schematically illustrates a process cartridge used in the present invention.

With reference to FIG. 30, next will be described a process cartridge accommodating the carrier for electrophotographic developer and the developer of the present invention.

A process cartridge 30 includes a photoconductor 131 serving as an image bearing member; a charging unit 132 configured to charge the surface of the photoconductor 131 (e.g., charging brush); a developing unit 133 configured to develop a latent electrostatic image formed on the photoconductor 131 using the carrier and developer of the present invention; and a cleaning unit 134 configured to remove the developer remaining on the photoconductor 131 (e.g., cleaning blade).

The process cartridge 130 is applied to an image forming apparatus. Image formation is performed with this image forming apparatus as follows. Specifically, the photoconductor 131 is rotated at a predetermined speed. While being rotated, the photoconductor 131 is uniformly positively/negatively charged at a predetermined level with the charging unit 132. Subsequently, the thus-charged photoconductor 131 is imagewise exposed to light emitted from the exposing unit (e.g., slit exposure and laser beam scanning exposure), to thereby form a latent electrostatic image. The thus-formed latent electrostatic image is developed using toner with the developing unit 133. The thus-developed toner image is transferred with the transfer unit onto a transfer member which is fed from a paper-feed portion to between the photoconductor 131 and the transfer unit in synchronization with rotation of the photoconductor 131. The transfer member having undergone image transfer is separated from the photoconductor and fed into the fixing unit for image fixing. The formed printed product is discharged from the image forming apparatus. The photoconductor surface after image transfer is cleaned with the cleaning unit (cleaning blade) 134 for removing the residual toner, followed by charge elimination. The thus-treated photoconductor is used for the subsequent electrophotographic process.

EXAMPLES

An embodiment of the present invention will next be described in more detail by way of Examples and Comparative Examples. Note that the unit "part(s)" is on a mass basis in the following description.

Toner Production Example A1

Firstly, toner samples were produced as follows.

Polyester resin: 100 parts

Carbon black: 5 parts

Fluorine-containing quaternary ammonium salt: 5 parts

The above-listed components were thoroughly mixed one another with a blender and then melt-kneaded with a biaxial extruder. After cooling in air, the resultant mixture was roughly pulverized using a cutter mill and then finely pulverized using a jet mill, followed by classifying with an air classifier, to thereby produce a toner base having a weight average particle diameter of 4.80 μm and true specific gravity of 1.20 g/cm$^3$. Subsequently, hydrophobic silica microparticles (R972, product of NIPPON AEROSIL CO., LTD.) (1.5 parts) were added to the thus-produced toner base (100 parts), and the resultant mixture was mixed using a Henschel mixer to produce toner I.

Toner Production Example A2

Hydrophobic silica microparticles (R972, product of NIPPON AEROSIL CO., LTD.) (1.0 part) and titanium oxide (0.5 parts) were added to the toner base (100 parts) produced in Toner Production Example A1, followed by mixing using a Henschel mixer, to thereby produce toner II.

Toner Production Example A3

Hydrophobic silica microparticles (R972, product of NIPPON AEROSIL CO., LTD.) (1.0 part), titanium oxide (0.5 parts) and zinc stearate (0.3 parts) were added to the toner base (100 parts) produced in Toner Production Example A1, followed by mixing using a Henschel mixer, to thereby produce toner III.

Table A1 given below shows the particle diameter of the above-obtained toners I to III and the true specific gravity of the base toner. Further, Table A1 shows components of each toner and the amounts thereof.

TABLE A1

| | Toner I | Toner II | Toner III |
|---|---|---|---|
| Particle diameter (μm) | 4.80 | 4.80 | 4.80 |
| True specific gravity (g/cm$^3$) | 1.20 | 1.20 | 1.20 |
| Silica (parts) | 1.5 | 1.0 | 1.0 |
| Titanium (parts) | 0.00 | 0.5 | 0.5 |
| Zinc stearate (parts) | 0.00 | 0.00 | 0.3 |

Toner Production Example B1

Firstly, polyester was synthesized. Specifically, a reaction vessel equipped with a condenser, a stirrer and a nitrogen-introducing tube was charged with a propylene oxide adduct of bisphenol A (34,090 parts), fumaric acid (5,800 parts) and dibutyltin oxide (15 parts). The resultant mixture was allowed to react under ambient pressure at 230° C. for 5 hours. Subsequently, the reaction mixture was further allowed to react under reduced pressure (10 mmHg to 15 mmHg) for 6 hours to synthesize polyester 1. The thus-obtained polyester 1 was found to have a glass transition temperature (Tg) of 63° C., weight average molecular weight (Mw) of 12,000, acid value of 22 mgKOH/g.

Next, toner was produced. Specifically, the above-synthesized polyester 1 (100 parts), a copper phthalocyanine pigment (2 parts) and a charge controlling agent having the following Structural Formula (A) (an iodide of perfluorononylene p-trimethylaminopropylamidephenyl ether) (2 parts) were kneaded with a heat roller at 120° C. The thus-kneaded product was cooled for solidification, followed by pulverization and classification, to thereby produce toner base particles. The thus-produced toner base particles were found to have a weight average particle diameter of 7.1 μm, number average particle diameter of 5.8 μm and average circularity of 0.953.

Structural Formula (A)

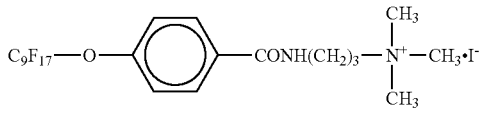

Thereafter, silica R972 (product of NIPPON AEROSIL CO., LTD.) (0.5 parts) was added to the above-produced toner base particles (100 parts), followed by mixing, to thereby produce toner IV.

Toner Production Example B2

The above-synthesized polyester 1 (100 parts), carbon black (Printex 60, product of Deggusa Co.) (5 parts) and a chromium-containing azo dye having the following Structural Formula (B) (2 parts) were kneaded one another with a heat roller at 120° C. The thus-kneaded product was cooled for solidification, followed by pulverization and classification, to thereby produce tone base particles. The thus-produced toner base particles were found to have a weight average particle diameter of 7.3 μm, number average particle diameter of 6.0 μm and average circularity of 0.955.

Structural Formula (B)

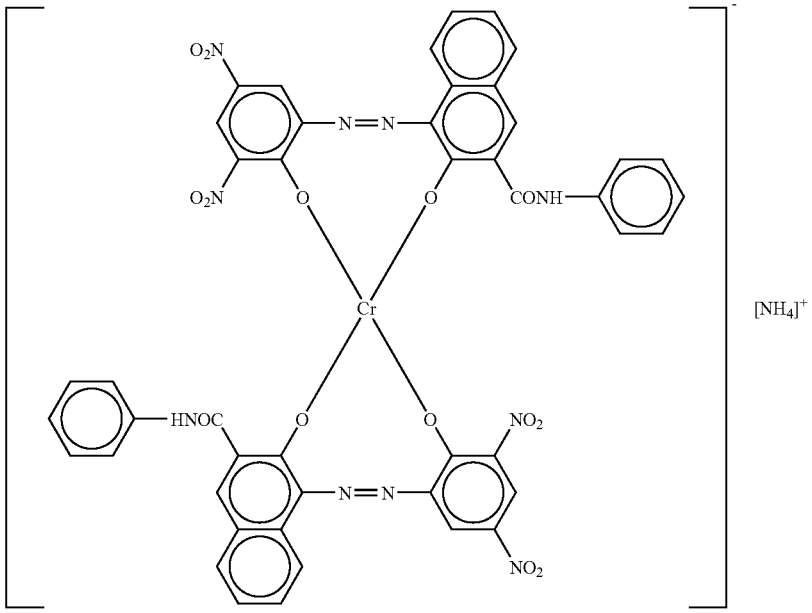

Thereafter, silica R972 (product of NIPPON AEROSIL CO., LTD.) (0.5 parts) was added to the above-produced toner base particles (100 parts), followed by mixing, to thereby produce toner V.

Toner Production Example B3

Firstly, an emulsion of organic microparticles was synthesized. Specifically, a reaction vessel equipped with a stirrer and a thermometer was charged with water (683 parts), a sodium salt of methacrylic acid ethylene oxide adduct sulfate (Eleminol RS-30, product of Sanyo Chemical Industries) (11 parts), styrene (83 parts), methacrylic acid (83 parts), butyl acrylate (110 parts) and ammonium persulfate (1 part). The resultant mixture was stirred at 400 rpm for 15 min to form a white emulsion. The thus-formed emulsion was heated so that the temperature of the reaction system was increased to 75° C., followed by reaction for 5 hours. Subsequently, a 1% by mass aqueous ammonium persulfate solution (30 parts) was added to the reaction mixture, followed by ripening at 75° C. for 5 hours, to thereby form a microparticle dispersion 1; i.e., an aqueous dispersion of a vinyl-based resin (a copolymer of styrene-methacrylic acid-butyl acrylate-sodium salt of methacrylic acid ethylene oxide adduct sulfate). Through measurement with a particle size distribution analyzer employing laser scattering (LA-920, product of Horiba, Ltd.), the microparticles contained in the thus-formed microparticle dispersion 1 were found to have a volume average particle diameter of 105 nm. A part of the microparticle dispersion 1 was dried and then only resin was isolated. The-thus isolated resin was found to have a glass transition temperature (Tg) of 59° C. and weight average molecular weight (Mw) of 150,000.

An aqueous phase was prepared from the microparticle dispersion 1. Specifically, water (990 parts), microparticle dispersion 1 (83 parts), a 48.5% by mass aqueous solution of dodecyl diphenyl ether sulfonic acid sodium (Eleminol MON-7, product of Sanyo Chemical Industries) (37 parts) and ethyl acetate (90 parts) were mixed/stirred, to thereby form an aqueous phase 1 as an opaque white liquid.

Subsequent to the production of the aqueous phase 1, low-molecular-weight polyester was synthesized. Specifically, a reaction vessel equipped with a condenser, a stirrer and a nitrogen-introducing tube was charged with an ethylene oxide 2-mole adduct of bisphenol A (229 parts), a propylene oxide 3-mole adduct of bisphenol A (529 parts), terephthalic acid (208 parts), adipic acid (46 parts) and dibutyltin oxide (2 parts), and the mixture was allowed to react at 230° C. for 8 hours under normal pressure. Subsequently, the resultant mixture was allowed to react for 5 hours under reduced pressure (10 mmHg to 15 mmHg). Thereafter, trimellitic anhydride (44 parts) was added to the reaction vessel, followed by reaction at 180° C. for 2 hours under normal pressure, to thereby synthesize low-molecular-weight polyester 1. The thus-obtained low-molecular-weight polyester 1 was found to have a glass transition temperature (Tg) of 45° C., weight average molecular weight (Mw) of 5,800, number average molecular weight of 2,600 and acid value of 24 mgKOH/g.

Next, a polyester prepolymer was synthesized. Specifically, a reaction vessel equipped with a condenser, a stirrer and a nitrogen-introducing tube was charged with an ethylene oxide 2-mole adduct of bisphenol A (682 parts), a propylene oxide 2-mole adduct of bisphenol A (81 parts), terephthalic acid (283 parts), trimellitic anhydride (22 parts) and dibutyltin oxide (2 parts), and the mixture was allowed to react at 230° C. for 8 hours under normal pressure. Subsequently, the resultant mixture was allowed to react for 5 hours under reduced pressure (10 mmHg to 15 mmHg), to thereby synthesize a polyester intermediate 1. The thus-obtained polyester intermediate 1 was found to have a number average molecular weight of 2,100, weight average molecular weight of 9,500, glass transition temperature (Tg) of 55° C., acid value of 0.5 mgKOH/g and hydroxyl value of 51 mgKOH/g.

A prepolymer 1 was produced from the thus-synthesized polyester intermediate 1. Specifically, a reaction vessel equipped with a condenser, a stirrer and a nitrogen introducing tube was charged with the above-obtained polyester intermediate 1 (410 parts), isophorone diisocyanate (89 parts) and ethyl acetate (500 parts), and the resultant mixture was allowed to react at 100° C. for 5 hours to prepare a prepolymer 1. The free isocyanate content of the thus-prepared prepolymer 1 was found to 1.74% by mass.

Next, ketimine was synthesized. Specifically, a reaction vessel equipped with a stirring rod and a thermometer was charged with isophorone diamine (170 parts) and methyl ethyl ketone (75 parts), and the resultant mixture was allowed to react at 50° C. for 5 hours to prepare a ketimine compound 1. The thus-prepared ketimine compound 1 was found to have an amine value of 418.

Next, a masterbatch (MB) was prepared. Specifically, water (1,200 parts), carbon black (PBk-7: Printex 60, product of Deggusa Co., DBP oil-absorption amount: 114 mL/100 mg, pH: 10) (540 parts) and a polyester resin (RS801, product of Sanyo Chemical Industries) (1,200 parts) were mixed one another with a Henschel mixer (product of Mitsui Mining Co.). Using a two-roll mill, the resultant mixture was kneaded at 150° C. for 30 min, followed by calendering and cooling. The product was pulverized with a pulverizer to prepare a masterbatch 1.

Next, an oil phase was prepared. Specifically, a reaction vessel equipped with a stirring rod and a thermometer was charged with the above-synthesized low-molecular-weight polyester 1 (300 parts), carnauba wax (90 parts), rice wax (10 parts) and ethyl acetate (1,000 parts), followed by stirring at 79° C. for dissolution. Subsequently, the resultant solution was quenched to 4° C. and then was dispersed with a bead mill (Ultra Visco Mill, product of Aymex Co.) under the following conditions: liquid-feeding rate: 1 kg/hr; disc circumferential speed: 6 m/sec; amount of 0.5 mm-zirconia beads charged: 80% by volume; and pass time: 3, to thereby produce a wax dispersion having a volume average molecular weight of 0.6 μm. Thereafter, the masterbatch 1 (500 parts) and a 70% by mass ethyl acetate solution of the low-molecular-weight polyester 1 (640 parts) were added to the thus-produced wax dispersion, followed by mixing for 10 hours. Subsequently, the resultant mixture was treated with the same bead mill as used above with the pass time being 5, and ethyl acetate was added to the thus-treated product for adjusting the solid content to 50% by mass, to thereby produce an oil phase 1.

Polymerization toner was produced from the oil phase 1. Specifically, a container was charged with the oil phase 1 (73.2 parts), the prepolymer 1 (6.8 parts) and the ketimine compound 1 (0.48 parts), and the resultant mixture was thoroughly mixed to prepare an emulsified oil phase 1. Subsequently, the aqueous phase 1 (120 parts) was added to the thus-prepared emulsified oil phase 1. The resultant mixture was mixed with a homomixer for 1 min and then flocculated under slowly stirring with a paddle for 1 hour, to thereby prepare an emulsion slurry 1. The solvent of the thus-obtained emulsion slurry 1 was removed at 30° C. for 1 hour, followed by ripening at 60° C. for 5 hours, washing with water, filtration and drying. Then, the obtained product was passed through a sieve with a mesh size of 75 μm, to thereby produce toner base particles having a weight average particle diameter of 6.1 μm, number average particle diameter of 5.4 μm and average circularity of 0.972.

Thereafter, hydrophobic silica (silica R972, product of NIPPON AEROSIL CO., LTD.) (0.7 parts) and hydrophobidized titanium oxide (MT-150A, product of TAYCA CORPORATION) (0.3 parts) were added to the above-produced toner base particles (100 parts), followed by mixing with a Henschel mixer, to thereby produce toner VI.

Carrier Production Example A1

Subsequently, carrier samples were produced as follows. Specifically, a silicone resin (SR2411, product of Dow Corning Toray Silicone Co.) and carbon (an amount of 10% with respect to the solid content of the resin) were dispersed in a solvent (toluene). The resultant dispersion was diluted so that the solid content thereof was adjusted to 5%, to thereby prepare a silicone resin mixture (solution). Separately, carrier core particles were produced as follows. Specifically, CuZn ferrite, a binder, a dispersant and a defoamer were mixed with one another to prepare a slurry. Using the carrier core production apparatus shown in FIG. 2, the thus-prepared slurry was formed into liquid droplets by vibrating nozzles at a vibration frequency of 104 kHz, to thereby produce primary granulated products. Notably, this particle formation could be reliably performed for 8 consecutive hours without intermittence caused by nozzle clogging, and the formed particles were found to be truly spherical and to have a weight average particle diameter of 22.7 μm and D4/Dn of 1.03. Subsequently, the additives (e.g., binder) were removed through decomposition from the primary granulated products at 700° C. with a rotary kiln. Thereafter, the resultant products were fired in an electric furnace for 5 hours at an oxygen concentration of 0.05% or lower and at a firing temperature of 1,300° C., to thereby produce carrier core particles (CuZn ferrites) having a weight average particle diameter of 25.0 μm (D4/Dn: 1.01, bulk density: 2.24 g/m$^3$, magnetization at 1,000 Oe: 58 emu/g). Thereafter, the above-prepared silicone resin mixture (solution) was applied onto the surface of each carrier core particles using a fluidized bed coater at 90° C. and at a coating rate of 30 g/min. The thus-treated carrier core was heated at 230° C. for 2 hours to form a carrier coat having an electrical resistivity Log R of 12.3 Ωcm, thickness of 0.21 μm and true specific gravity of 5.1 g/cm$^3$, to thereby produce carrier A. Note that the thickness of the carrier coat was adjusted by changing the amount of a coat liquid used.

Carrier Production Example A2

The procedure of Carrier Production Example A1 was repeated, except that the production conditions were changed so that the weight average particle diameter of the formed carrier core particles was adjusted to 30.0 μm, to thereby produce carrier B. This particle formation could be reliably performed for 8 consecutive hours without nozzle clogging.

Carrier Production Example A3

The procedure of Carrier Production Example A1 was repeated, except that the production conditions were changed so that the weight average particle diameter of the formed carrier core particles was adjusted to 35.0 μm, to thereby produce carrier C. This particle formation could be reliably performed for 8 consecutive hours without nozzle clogging.

Carrier Production Example A4

The procedure of Carrier Production Example A1 was repeated, except that the vibration frequency was changed to 20 kHz so that the weight average particle diameter of the formed carrier core particles was adjusted to 27.3 μm, to thereby produce carrier D. This particle formation could be reliably performed for 8 consecutive hours without nozzle clogging.

Carrier Production Example A5

The procedure of Carrier Production Example A1 was repeated, except that the vibration frequency was changed to 300 kHz so that the weight average particle diameter of the formed carrier core particles was adjusted to 22.4 μm, to thereby produce carrier E. This particle formation could be reliably performed for 8 consecutive hours without nozzle clogging.

Carrier Production Example A6

The procedure of Carrier Production Example A1 was repeated, except that CuZn ferrite for forming the carrier core particles was changed to MnMgSr, to thereby produce carrier F. This particle formation could be reliably performed for 8 consecutive hours without nozzle clogging.

Carrier Production Example A7

The procedure of Carrier Production Example A1 was repeated, except that CuZn ferrite for forming the carrier core particles was changed to Mn ferrite, to thereby produce carrier G. This particle formation could be reliably performed for 8 consecutive hours without nozzle clogging.

Carrier Production Example A8

The procedure of Carrier Production Example A1 was repeated, except that CuZn ferrite for forming the carrier core particles was changed to magnetite, to thereby produce carrier H. This particle formation could be reliably performed for 8 consecutive hours without nozzle clogging.

Carrier Production Example A9

The procedure of Carrier Production Example A1 was repeated, except that aminosilane was added to the silicone resin solution for forming a carrier coat, to thereby produce carrier I. This particle formation could be reliably performed for 8 consecutive hours without nozzle clogging.

Carrier Production Example A10

Carrier J was produced as follows. Specifically, CuZn to ferrite (carrier core particles), a binder, a dispersant and a defoamer were mixed with one another to prepare a slurry. The thus-obtained slurry was formed into liquid droplets using an orifice-vibration granulator having the configuration shown in FIG. 1, to thereby produce primary granulated products. This particle formation could not be continuously performed. This is because nozzle parts were required to be deassembled for washing every nozzle clogging with operation of the apparatus being stopped, since magnetic particles were aggregated at the openings of the nozzles for merely 1 hour or so. As a result, it took as long as 13 hours to perform particle formation for 6 hours, since the nozzle parts were deassembled for washing at 11 times in total. Carrier J was found to be truly spherical and to have a weight average particle diameter of 33.0 μm and D4/Dn of 1.21 (note that this D4/Dn was measured after classification).

Table A2 given below shows properties of the carrier core particles and the carrier coat constituting carriers A to J.

TABLE A2

| | | Properties of carrier core particles | | | | | Properties of carrier coat | | |
|---|---|---|---|---|---|---|---|---|---|
| Prodn. Ex. | Carrier | D4 (μm) | D4/Dn | Bulk density (g/cm$^3$) | Magnetization (emu/g) | Raw material | Resistivity Log R (250 V) | Thickness (μm) | Amino silane content |
| A1 | A | 25.0 | 1.01 | 2.24 | 58 | CuZn | 12.3 | 0.21 | Not added |
| A2 | B | 30.0 | 1.01 | 2.27 | 59 | CuZn | 12.1 | 0.22 | Not added |
| A3 | C | 35.0 | 1.01 | 2.22 | 56 | CuZn | 12.2 | 0.20 | Not added |
| A4 | D | 27.3 | 1.03 | 2.25 | 55 | CuZn | 12.5 | 0.23 | Not added |
| A5 | E | 22.4 | 1.05 | 2.24 | 56 | CuZn | 12.2 | 0.22 | Not added |
| A6 | F | 25.0 | 1.01 | 2.52 | 65 | MnMgSr | 12.0 | 0.23 | Not added |
| A7 | G | 25.0 | 1.01 | 2.49 | 71 | Mn ferrite | 12.3 | 0.22 | Not added |
| A8 | H | 25.0 | 1.01 | 2.48 | 75 | Magnetite | 12.0 | 0.21 | Not added |
| A9 | I | 25.0 | 1.01 | 2.24 | 58 | CuZn | 12.1 | 0.22 | 2 parts |
| A10 | J | 33.0 | 1.21 | 2.24 | 57 | CuZn | 12.1 | 0.23 | Not added |

Developers of Examples A1 to A14 and Comparative Example A1 were prepared from toners I to VI produced in Toner Production Examples A1 to A3 and B1 to B3 and carriers A to J produced in Carrier Production Examples A1 to A10. Image formation was performed using each of the thus-prepared developers for evaluating image quality and reliability with an imagio Color 4000 (digital color copier/printer complex machine, product of Ricoh Co., Ltd.) under the following conditions.

—Developing Conditions—

Developing gap (between photoconductor and developing sleeve): 0.35 mm

Doctor gap (between developing sleeve and doctor): 0.65 mm

Linear velosity of photoconductor: 200 mm/sec

Linear velosity of developing sleeve/linear velosity of photoconductor: 1.80

Writing density: 600 dpi

Charge potential (Vd): −600V

Post-exposure potential of area corresponding to image portion (solid portion) (VI): −150V Developing bias: DC −500V/AC 2 kHz, −100V to −900V, 50% duty Carrier adhesion was evaluated as follows: an adhesive tape was applied onto the photoconductor after development and before transfer; and the tape was observed. Meanwhile, image quality was evaluated on the recording medium as follows (image evaluation test).

(1) Image Density

Each of the images formed under the above developing conditions was measured for the density of 5 points at a center portion of 30 mm×30 mm-solid image using an X-Rite 938 spectrodensitometer, and the obtained values were averaged.

(2) Uniformity of Image (Granularity)

The granularity was calculated using the following equation (brightness range: 50 to 80), and the obtained value was ranked as follows (Rank 10 is the best).

$$\text{Granularity}=\exp(aL+b)\int(WS(f))^{1/2}\cdot VTF(f)df$$

where L denotes an average brightness, f denotes a spatial frequency (cycle/mm), WS(f) denotes power spectrum of brightness fluctuation, VTF(f) denotes a visual spatial-frequency characteristic, and each of a and b is a coefficient.

[Rank]

Rank 10: −0.10 inclusive to 0 exclusive

Rank 9: 0 inclusive to 0.05 exclusive

Rank 8: 0.05 inclusive to 0.10 exclusive

Rank 7: 0.10 inclusive to 0.15 exclusive

Rank 6: 0.15 inclusive to 0.20 exclusive

Rank 5: 0.20 inclusive to 0.25 exclusive

Rank 4: 0.25 inclusive to 0.30 exclusive

Rank 3: 0.30 inclusive to 0.40 exclusive

Rank 2: 0.40 inclusive to 0.50 exclusive

Rank 1: 0.50 or greater (3) Background Smear

Each of the images formed under the above developing conditions was measured for the degree of background smear according to the following 10 ranks. Note that the higher the rank, the less the degree of the background smear, and Rank 10 is the best.

(Evaluation Method)

The Number of Toner Particles Adhering to the Background (non-image portion) of each recording media was counted and the obtained number was reduced to a number per 1 cm$^2$. This was evaluated according to the following ranks, each rank corresponding to the number of toner particles per 1 cm$^2$.

[Rank]

Rank 10: 0 to 36

Rank 9: 37 to 72

Rank 8: 73 to 108

Rank 7: 109 to 144

Rank 6: 145 to 180

Rank 5: 181 to 216

Rank 4: 217 to 252

Rank 3: 253 to 288

Rank 2: 289 to 324

Rank 1: 325 or more (4) Carrier Adhesion

Carrier adhesion causes scratches on a photoconductor drum and/or fixing roller, leading to reduction of image quality. In evaluation, an adhesive tape was applied onto the photoconductor. This is because only part of carriers is transferred onto a paper even when carrier adhesion occurs.

(Evaluation Method)

An image pattern of 2-dot line (100 lpi/inch) was formed in a sub-scanning direction, followed by developing at a DC bias of 400V. The number of carriers (per 100 cm$^2$) adhering to a space between the lines of the 2-dot line was counted and evaluated according to the following ranks. Note that Rank 10 is the best.

[Rank]

Rank 10: 0

Rank 9: 1 to 10

Rank 8: 11 to 20

Rank 7: 21 to 30
Rank 6: 31 to 50
Rank 5: 51 to 100
Rank 4: 101 to 300
Rank 3: 301 to 600
Rank 2: 601 to 1,000
Rank 1: 1,000 or more (5) Cleanability In a test room with the temperature/humidity being adjusted to 10° C./15% RH, ten recording media having a solid black image (A4 size) were continuously printed out and then printing of a recording medium having a blank image was performed. In this 11th printing, the printer was stopped before the blank recording medium was output. In this state, a piece of scotch tape (product of Sumitomo 3M Ltd.) was made to adhere to the photoconductor surface having undergone a cleaning step. Then, the obtained tape was made to adhere to a blank sheet for transferring the residual toner particles thereto. Subsequently, the blank sheet was subjected to measurement using a Macbeth reflection densitometer (model RD514) and the obtained measurements were evaluated according to the following criteria.

[Evaluation Criteria]

A: No difference between measurement of blank sheet and blank value; i.e., excellent cleanability B: Difference between measurement of blank sheet and blank value less than 0.02; i.e., good cleanability C: Difference between measurement of blank sheet and blank value more than 0.02; i.e., bad cleanability (6) Amount of Developer Pumped Up The amount of a developer pumped up to the developing sleeve per 1 $cm^2$ was measured.

(7) Charging Amount of Carrier

A toner (10 parts) and a carrier (100 parts) were sufficiently charged through mixing for 10 min at a temperature/humidity of 28° C./80% RH. Subsequently, the carrier was separated from the toner using an SUS filter (400 mesh). The thus-obtained carrier was measured for its charging amount with the suction blow-off charging amount measuring method.

Example A1

Toner I (6.55 parts) was added to carrier A (100 parts), followed by stirring using a ball mill for 20 min, to thereby prepare a 6.54% by mass developer. The coverage of the carrier with the toner was found to be 50%, and the charging amount of the toner −32 μc/g.

Image formation was performed with an imagio Color 4000 (product of Ricoh Co., Ltd.) using the thus-prepared developer and then the obtained image was evaluated for its image quality according to the above-described image evaluation test. As a result, practically excellent properties were observed; i.e., image density: 1.63; granularity: Rank 7; background smear: Rank 8; and carrier adhesion: Rank 9. Subsequently, the above-described cleaning test was performed, and cleaning failure was slightly observed. Thereafter, this imagio Color was subjected to running of 100,000 sheet-printing of a character image chart with an image area ratio of 6%, followed by evaluation of the obtained image. As a result, this image was found to exhibit background smear to a low extent (i.e., Rank 7). Also, the granularity was found to be the same as in an initial state (i.e., Rank 7), indicating that the image quality was maintained. The results are shown in Table A3. Examples A2 to A14 and Comparative Example A1

Similar to Example A1, toners I to VI were mixed with carriers B to J in a combination shown in Table A3 so that the coverage of the carrier with the toner was adjusted to 50%, to thereby prepare developers of Examples A2 to A14 and Comparative Example A1. Subsequently, each of the thus-prepared developers was subjected to the same measurement and evaluation as performed in Example A1. The results are shown in Table A3.

Table A3-1

| | Initial characteristics | | | | | | | | |
|---|---|---|---|---|---|---|---|---|---|
| | Carrier | Toner | Charging amount of carrier (μC/g) | Image density | Granularity | Background smear | Carrier adhesion | Cleanability | Amount of developer pumped up (mg/$cm^2$) |
| Ex. A1 | A | I | −32.8 | 1.64 | 8 | 9 | 10 | A | 50 |
| Ex. A2 | B | I | −31.7 | 1.62 | 8 | 8 | 9 | A | 51 |
| Ex. A3 | C | I | −29.9 | 1.65 | 7 | 8 | 10 | A | 53 |
| Ex. A4 | D | I | −32.1 | 1.62 | 8 | 9 | 9 | A | 52 |
| Ex. A5 | E | I | −31.3 | 1.64 | 8 | 9 | 9 | A | 54 |
| Ex. A6 | F | I | −31.4 | 1.68 | 7 | 9 | 10 | A | 51 |
| Ex. A7 | G | I | −34.1 | 1.60 | 8 | 8 | 10 | A | 52 |
| Ex. A8 | H | I | −31.2 | 1.63 | 7 | 9 | 10 | A | 54 |
| Ex. A9 | I | I | −32.4 | 1.63 | 8 | 9 | 9 | A | 51 |
| Comp. Ex. A1 | J | I | −32.4 | 1.63 | 6 | 6 | 5 | A | 51 |
| Ex. A10 | A | II | −32.4 | 1.63 | 8 | 9 | 9 | A | 51 |
| Ex. A11 | B | III | −33.1 | 1.60 | 8 | 8 | 9 | A | 51 |
| Ex. A12 | A | IV | −32.4 | 1.62 | 9 | 8 | 9 | A | 50 |
| Ex. A13 | A | V | −32.5 | 1.65 | 8 | 9 | 9 | A | 52 |
| Ex. A14 | A | VI | −33.1 | 1.64 | 8 | 8 | 9 | A | 51 |

Table A3-2

| | Characteristics after running of 100,000-sheet printing | | | | | | | | |
|---|---|---|---|---|---|---|---|---|---|
| | Carrier | Toner | Charging amount of carrier (μC/g) | Image density | Granularity | Background smear | Carrier adhesion | Cleanability | Amount of developer pumped up (mg/$cm^2$) |
| Ex. A1 | A | I | −33.2 | 1.62 | 7 | 9 | 10 | A | 50 |
| Ex. A2 | B | I | −31.4 | 1.62 | 8 | 8 | 10 | A | 51 |

-continued

| | | | | | | | | | |
|---|---|---|---|---|---|---|---|---|---|
| Ex. A3 | C | I | −29.7 | 1.64 | 8 | 8 | 10 | A | 53 |
| Ex. A4 | D | I | −32.5 | 1.63 | 8 | 9 | 9 | A | 52 |
| Ex. A5 | E | I | −31.7 | 1.62 | 8 | 9 | 9 | A | 53 |
| Ex. A6 | F | I | −32.1 | 1.62 | 7 | 8 | 9 | A | 51 |
| Ex. A7 | G | I | −33.5 | 1.62 | 8 | 8 | 8 | A | 46 |
| Ex. A8 | H | I | −31.0 | 1.61 | 8 | 8 | 9 | A | 52 |
| Ex. A9 | I | I | −32.8 | 1.62 | 8 | 8 | 9 | A | 49 |
| Comp. Ex. A1 | J | I | −32.0 | 1.63 | 6 | 4 | 4 | C | 46 |
| Ex. A10 | A | II | −32.4 | 1.64 | 8 | 9 | 9 | A | 51 |
| Ex. A11 | B | III | −31.2 | 1.64 | 7 | 7 | 8 | A | 51 |
| Ex. A12 | A | IV | −32.5 | 1.63 | 8 | 8 | 9 | A | 52 |
| Ex. A13 | A | V | −32.9 | 1.64 | 9 | 9 | 9 | A | 51 |
| Ex. A14 | A | VI | −31.9 | 1.62 | 8 | 9 | 9 | A | 50 |

As is clear from Table A3, each of the developers of Examples A1 to A14 was found to provide an image having a practically sufficient image quality, and also to exhibit practically excellent cleanability. Furthermore, after running of 100,000 sheet-printing, a high-quality image was found to be formed.

Carrier Production Example B1

A silicone resin (SR2411, product of Dow Corning Toray Silicone Co.) and carbon (an amount of 10% with respect to the solid content of the resin) were dispersed in a solvent (toluene). The resultant dispersion was diluted so that the solid content thereof was adjusted to 5%, to thereby prepare a silicone resin mixture (solution).

Separately, carrier core particles were produced using a carrier core particle production apparatus shown in FIG. 15 as follows. Specifically, Mn ferrite, a binder, a dispersant and a defoamer were mixed with one another to prepare a slurry. The thus-prepared slurry was formed into liquid droplets to produce monodisperse primary granulated products. Notably, this particle formation could be reliably performed for 8 consecutive hours without intermittence caused by nozzle clogging, and the formed particles were found to be truly spherical and to have a weight average particle diameter of 22.7 μm and D4/Dn of 1.03. Subsequently, the additives (e.g., binder) were removed through decomposition from the primary granulated products at 700° C. with a rotary kiln. Thereafter, the resultant products were fired in an electric furnace for 5 hours at an oxygen concentration of 0.05% or lower and at a firing temperature of 1,300° C., to thereby produce carrier core particles having a weight average particle diameter of 19.7 μm (D4/Dn: 1.03, bulk density: 2.50 g/m$^3$, magnetization at 1,000 Oe: 60 emu/g).

Thereafter, the above-prepared silicone resin (mixture) solution was applied onto the surface of each carrier core particles using a fluidized bed coater at 90° C. and at a coating rate of 30 g/min. The thus-treated carrier core was heated at 230° C. for 2 hours to form a carrier coat having an electrical resistivity Log R of 11.9 Ωcm, thickness of 0.20 μm and true specific gravity of 5.1 g/cm$^3$, to thereby produce carrier A1. Note that the thickness of the carrier coat was adjusted by changing the amount of a coat liquid used.

Carrier Production Example B2

The procedure of Carrier Production Example B1 was repeated, except that the production conditions were changed so that the weight average particle diameter of the formed carrier core particles was adjusted to 24.7 to thereby produce carrier B1. This particle formation could be reliably performed for 8 consecutive hours without nozzle clogging.

Carrier Production Example B3

The procedure of Carrier Production Example B1 was repeated, except that the production conditions were changed so that the weight average particle diameter of the formed carrier core particles was adjusted to 32.7 μm, to thereby produce carrier C1. This particle formation could be reliably performed for 8 consecutive hours without nozzle clogging.

Carrier Production Example B4

The procedure of Carrier Production Example B1 was repeated, except that Mn ferrite for forming the carrier core particles was changed to MnMgSr, to thereby produce carrier D1. This particle formation could be reliably performed for 8 consecutive hours without nozzle clogging.

Carrier Production Example B5

The procedure of Carrier Production Example B1 was repeated, except that Mn ferrite for forming the carrier core particles was changed to CuZn ferrite, to thereby produce carrier E1. This particle formation could be reliably performed for 8 consecutive hours without nozzle clogging.

Carrier Production Example B6

The procedure of Carrier Production Example B1 was repeated, except that Mn ferrite for forming the carrier core particles was changed to magentite, to thereby produce carrier F1. This particle formation could be reliably performed for 8 consecutive hours without nozzle clogging.

Carrier Production Example B7

The procedure of Carrier Production Example B1 was repeated, except that aminosilane was added to the silicone resin solution for forming a carrier coat, to thereby produce carrier G1. This particle formation could be reliably performed for 8 consecutive hours without nozzle clogging.

Carrier Comparative Production Example B1

Carrier H1 was produced as follows. Specifically, Mn ferrite (carrier core particles), a binder, a dispersant and a defoamer were mixed with one another to prepare a slurry. The thus-obtained slurry was formed into liquid droplets using a vibrating-orifice granulator shown in FIG. 1 to produce primary granulated products. This particle formation could not be continuously performed. This is because nozzle parts were required to be deassembled for washing every nozzle clogging with operation of the apparatus being stopped, since magnetic particles were aggregated at the openings of the nozzles for merely 1 hour or so. As a result, it took as long as 13 hours to perform particle formation for 6 hours, since the nozzle parts were deassembled for washing at 11 times in total. Carrier H1 was found to be truly spherical and to have a weight average particle diameter of 19.9 μm and D4/Dn of 1.03 (note that this D4/Dn was measured after classification).

Table B1 given below shows properties of the carrier core particles and the carrier coat constituting carriers A1 to H1.

Table B1

| | | Properties of carrier core particles | | | | | Properties of carrier coat | | |
|---|---|---|---|---|---|---|---|---|---|
| | Carrier | D4 (μm) | D4/Dn | Bulk density (g/cm$^3$) | Magnetization (emu/g) | Raw material | Resistivity Log R (250 V) | Thickness (μm) | Amino silane content |
| Prodn. Ex. B1 | A1 | 19.7 | 1.03 | 2.6 | 69 | Mn ferrite | 11.9 | 0.2 | Not added |
| Prodn. Ex. B2 | B1 | 24.7 | 1.03 | 2.54 | 68 | Mn ferrite | 12.2 | 0.21 | Not added |
| Prodn. Ex. B3 | C1 | 32.7 | 1.02 | 2.55 | 67 | Mn ferrite | 12 | 0.19 | Not added |
| Prodn. Ex. B4 | D1 | 19.8 | 1.03 | 2.56 | 66 | MnMgSr | 11.8 | 0.21 | Not added |
| Prodn. Ex. B5 | E1 | 19.9 | 1.02 | 2.22 | 59 | CuZn | 12 | 0.2 | Not added |
| Prodn. Ex. B6 | F1 | 19.6 | 1.03 | 2.54 | 74 | Magnetite | 12.2 | 0.22 | Not added |
| Prodn. Ex. B7 | G1 | 19.9 | 1.03 | 2.55 | 69 | Mn ferrite | 12 | 0.21 | 2 parts |
| Comp. Prodn. Ex. B1 | H1 | 19.9 | 1.03 | 2.54 | 68 | Mn ferrite | 12 | 0.2 | Not added |

Developers of Examples B1 to B9 and Comparative Example B1 were prepared from toners IV to VI produced in Toner Production Examples B1 to B3 and carriers A1 to H1 produced in Carrier Production Examples B1 to B7 and Carrier Comparative Production Example B1. Similar to Examples A1 to A14 and Comparative Example A1, image formation was performed using each of the thus-prepared developers for evaluating image quality and reliability.

Example B1

Toner 3 (6.55 parts) was added to carrier A (100 parts), followed by stirring using a ball mill for 20 min, to thereby prepare a 6.54% by mass developer. The coverage of the carrier with the toner was found to be 50%, and the charging amount of the toner −32 μc/g.

Image formation was performed with an imagio Color 4000 (product of Ricoh Co., Ltd.) using the thus-prepared developer and then the obtained image was evaluated for its image quality according to the above-described image evaluation test. As a result, practically excellent properties were obtained; i.e., image density: 1.64; granularity: Rank 8; background smear: Rank 9; and carrier adhesion: Rank 10. Subsequently, the above-described cleaning test was performed, and allowable cleaning failure was observed. Thereafter, this imagio Color was subjected to running of 100,000 sheet-printing of a character image chart with an image area ratio of 6%, followed by evaluation of the obtained image. As a result, this image was found to exhibit background smear to a low extent (i.e., Rank 9). Also, the granularity was found to be the same as in an initial state (i.e., Rank 8), indicating that the image quality was maintained. The results are shown in Table B2.

Examples B2 to B9 and Comparative Example B1

Similar to Example B1, toners 1 to 3 were mixed with carriers B to G in a combination shown in Table B2 so that the coverage of the carrier with the toner was adjusted to 50%, to thereby prepare developers of Examples B2 to B9 and Comparative Example B1. Subsequently, each of the thus-prepared developers was subjected to the same measurement and evaluation as performed in Example B1. The results are shown in Table B2.

Table B2-1

| | Initial characteristics | | | | | | | | |
|---|---|---|---|---|---|---|---|---|---|
| | Carrier | Toner | Charging amount of carrier (μC/g) | Image density | Granularity | Background smear | Carrier adhesion | Cleanability | Amount of developer pumped up (mg/cm$^2$) |
| Ex. B1 | A1 | VI | −32.0 | 1.64 | 8 | 9 | 10 | A | 50 |
| Ex. B2 | B1 | VI | −31.9 | 1.62 | 7 | 8 | 9 | A | 51 |
| Ex. B3 | C1 | VI | −32.3 | 1.65 | 7 | 8 | 9 | A | 53 |
| Ex. B4 | D1 | VI | −33.1 | 1.67 | 8 | 8 | 10 | A | 54 |
| Ex. B5 | E1 | VI | −31.2 | 1.64 | 8 | 8 | 9 | A | 53 |
| Ex. B6 | F1 | VI | −32.9 | 1.68 | 8 | 8 | 10 | A | 51 |
| Ex. B7 | G1 | VI | −31.1 | 1.60 | 8 | 9 | 10 | A | 52 |
| Ex. B8 | A1 | V | −31.9 | 1.63 | 8 | 9 | 10 | A | 51 |
| Ex. B9 | B1 | IV | −31.5 | 1.60 | 7 | 8 | 9 | A | 54 |
| Comp. Ex. B1 | H1 | IV | −30.8 | 1.59 | 7 | 8 | 8 | A | 53 |

-continued

Table B2-2

| | Characteristics after running of 100,000-sheet printing | | | | | | | | |
|---|---|---|---|---|---|---|---|---|---|
| | Carrier | Toner | Charging amount of carrier (μC/g) | Image density | Granularity | Background smear | Carrier adhesion | Cleanability | Amount of developer pumped up (mg/cm$^2$) |
| Ex. B1 | A1 | VI | −31.2 | 1.62 | 8 | 8 | 10 | A | 50 |
| Ex. B2 | B1 | VI | −31.5 | 1.62 | 7 | 7 | 8 | A | 48 |
| Ex. B3 | C1 | VI | −32.1 | 1.64 | 7 | 7 | 8 | A | 49 |
| Ex. B4 | D1 | VI | −33.2 | 1.63 | 8 | 8 | 9 | A | 53 |
| Ex. B5 | E1 | VI | −32.8 | 1.64 | 8 | 8 | 8 | A | 50 |
| Ex. B6 | F1 | VI | −31.4 | 1.62 | 8 | 8 | 9 | A | 49 |
| Ex. B7 | G1 | VI | −32.5 | 1.65 | 8 | 9 | 10 | A | 52 |
| Ex. B8 | A1 | V | −33.2 | 1.64 | 8 | 8 | 10 | A | 50 |
| Ex. B9 | B1 | IV | −32.1 | 1.64 | 7 | 7 | 8 | A | 50 |
| Comp. Ex. B1 | H1 | IV | −32.1 | 1.61 | 7 | 7 | 8 | A | 51 |

As is clear from Table B2, each of the developers of Examples B1 to B9 was found to provide an image having a practically sufficient image quality, and also to exhibit practically excellent cleanability. Furthermore, after running of 100,000 sheet-printing, a high-quality image was found to be formed.

The invention claimed is:

1. A method for producing a carrier, comprising:

periodically forming and discharging liquid droplets of a carrier core composition liquid from a plurality of nozzles formed in a thin film, with a liquid droplet forming unit comprising the thin film and a vibration generating unit configured to vibrate the thin film;

forming carrier core particles by solidifying the discharged liquid droplets; and coating the carrier core particles with a resin layer.

2. The method according to claim 1, wherein the vibration generating unit is a ring-shaped vibration generating unit disposed in a deformable area of the thin film along a circumference of the deformable area.

3. The method according to claim 1, wherein the thin film of the liquid droplet forming unit comprises a convex portion which is formed with a plurality of nozzles and projects in a direction in which the liquid droplets are discharged.

4. The method according to claim 1, wherein the thin film is formed from a metal plate having a thickness of 5 μm to 100 μm, and each of the nozzles has a pore size of 10 μm to 50 μm.

5. The method according to claim 1, wherein the nozzles are vibrated at a vibration frequency of 20 kHz to 300 kHz.

6. The method according to claim 1, wherein the liquid droplet forming unit further comprises a vibration amplifying unit which is configured to amplify a vibration generated from the vibration generating unit and which has a vibration applying surface for applying the vibration to a target, the vibration applying surface being disposed so as to face the thin film, and a liquid feeding unit configured to feed the carrier core composition liquid to a space between the vibration applying surface and the thin film.

7. The method according to claim 6, wherein the vibration amplifying unit is a horn vibrator.

8. The method according to claim 6, wherein the vibration generating unit is configured to generate a vibration having a frequency within a range of 20 kHz or higher and lower than 2.0 MHz.

9. The method according to claim 6, wherein the plurality of nozzles are formed in the thin film so as to be arranged in an area where a sound pressure transmitted from the vibration amplifying unit falls within a range of 10 kPa to 500 kPa.

10. The method according to claim 6, wherein the plurality of nozzles are formed in the thin film so as to be arranged in an extended area from a position where a maximum displacement caused by a vibration is obtained to a position where a displacement is equal to or higher than 50% of the maximum displacement.

11. A carrier comprising:

carrier core particles, wherein the carrier is obtained by a method for producing a carrier so as to have a weight average particle diameter D4 of 15 μm to 35 μm, wherein a ratio (D4/Dn) of the weight average particle diameter D4 to a number average particle diameter Dn is 1.0 to 1.5, and wherein the method comprises:

periodically forming and discharging liquid droplets of a carrier core composition liquid from a plurality of nozzles formed in a thin film, with a liquid droplet forming unit comprising the thin film and a vibration generating unit configured to vibrate the thin film;

forming the carrier core particles by solidifying the discharged liquid droplets; and coating the carrier core particles with a resin layer.

12. The carrier according to claim 11, wherein the bulk density is 2.15 g/cm$^3$ to 2.70 g/cm$^3$ and the carrier core particles have a magnetization of 40 emu/g to 150 emu/g under an applied magnetic field of 1,000 Oersted.

13. The carrier according to claim 11, wherein the carrier core particles comprise at least one of an MnMgSr ferrite, an Mn ferrite, and a magnetite.

14. The carrier according to claim 11, having a resin layer formed of a silicone resin and an amino silane coupling agent.

15. A developer comprising:

a toner; and a carrier, wherein the carrier is obtained by a method for producing a carrier, wherein the method comprises:

periodically forming and discharging liquid droplets of a carrier core composition liquid from a plurality of nozzles formed in a thin film, with a liquid droplet forming unit comprising the thin film and a vibration generating unit configured to vibrate the thin film;

forming the carrier core particles by solidifying the discharged liquid droplets; and coating the carrier core particles with a resin layer, and wherein the carrier has a weight average particle diameter D4 of 15 μm to 35 μm, and a ratio (D4/Dn) of the weight average particle diameter D4 to a number average particle diameter Dn is 1.0 to 1.5; and the toner is charged with an absolute charging amount of 15 μc/g to 50 μc/g when the coverage of the carrier with the toner is 50%.

* * * * *